US010004298B2

(12) United States Patent
Bunch

(10) Patent No.: US 10,004,298 B2
(45) Date of Patent: Jun. 26, 2018

(54) FOOTWEAR TRACTION DEVICES AND SYSTEMS AND MECHANISMS FOR MAKING DURABLE CONNECTIONS TO SOFT BODY MATERIALS

(71) Applicant: Kahtoola, Inc., Flagstaff, AZ (US)

(72) Inventor: Christopher Bunch, Flagstaff, AZ (US)

(73) Assignee: KAHTOOLA, INC., Flagstaff, AZ (US)

( * ) Notice: Subject to any disclaimer, the term of this patent is extended or adjusted under 35 U.S.C. 154(b) by 0 days. days.

(21) Appl. No.: 14/573,790

(22) Filed: Dec. 17, 2014

(65) Prior Publication Data

US 2015/0230561 A1 Aug. 20, 2015

Related U.S. Application Data

(60) Provisional application No. 61/917,345, filed on Dec. 17, 2013.

(51) Int. Cl.

| | |
|---|---|
| ***A43C 15/06*** | (2006.01) |
| ***A43C 15/02*** | (2006.01) |
| ***A43C 15/04*** | (2006.01) |

(52) U.S. Cl.

CPC ..... *A43C 15/061* (2013.01); *A43C 15/02* (2013.01); *A43C 15/04* (2013.01)

(58) Field of Classification Search

CPC ..... A43C 15/061; A43C 15/02; A43C 15/04; A43C 15/00; A43C 15/06; A43C 15/08; A43C 15/09; A43C 15/063; A43C 15/005; A43C 15/065; A43C 15/068; A43C 15/10; A43C 15/12; A43C 15/16; A43B 13/223

USPC .... 36/59 C, 59 R, 134, 7.7, 7.6, 51, 163, 52

See application file for complete search history.

(56) References Cited

U.S. PATENT DOCUMENTS

| | | | | |
|---|---|---|---|---|
| 236,155 | A * | 1/1881 | Harris | A43C 11/00 24/659 |
| 1,195,866 | A * | 8/1916 | Stephan | A43C 15/06 36/7.6 |
| 1,760,084 | A * | 5/1930 | Pierce | A43C 15/161 36/59 R |
| 2,040,186 | A * | 5/1936 | Riddell | A43C 15/161 36/107 |

(Continued)

FOREIGN PATENT DOCUMENTS

| | | |
|---|---|---|
| EP | 2664246 | 11/2013 |
| GB | 1198419 A | 7/1970 |
| WO | WO 2010/027465 | 3/2010 |

OTHER PUBLICATIONS

"Shore Hardness Scales", SmoothOn, 2008.*

(Continued)

*Primary Examiner* — Shaun R Hurley
*Assistant Examiner* — Bao-Thieu L Nguyen
(74) *Attorney, Agent, or Firm* — King & Spalding LLP

(57) ABSTRACT

The present disclosure is directed toward a device that can be worn over footwear to provide traction, such as on slick or slippery surfaces, in snow, or on ice. Described embodiments include footwear accessory devices comprising at least one cleat that provides traction but does not add significantly to the profile of the footwear during use. The present disclosure is also directed toward to connecting bodies that can be used to couple objects to a stretchy material.

18 Claims, 18 Drawing Sheets

(56) References Cited

U.S. PATENT DOCUMENTS 2,216,947 A * 10/1940 Jones ..... A43C 15/02 236/92 B
2,532,485 A * 12/1950 Dowling ..... A43C 15/10 36/132
2,668,373 A * 2/1954 Russo ..... A43B 5/18 36/127
D207,771 S * 5/1967 Aufenacker ..... 36/52
3,461,576 A * 8/1969 Hubbard ..... A43B 15/00 36/32 R
D237,562 S * 11/1975 Nobuyuki ..... 36/59 R
4,246,707 A * 1/1981 Pedersen ..... A43B 3/16 36/100
4,338,733 A * 7/1982 Frechin ..... A43C 15/068 36/135
4,353,172 A * 10/1982 Bryant ..... A43C 15/068 36/62
4,524,966 A * 6/1985 Shannon ..... A47D 13/105 297/273
5,533,277 A * 7/1996 Bell ..... A43C 15/06 36/59 C
5,689,901 A * 11/1997 Bell ..... A43C 15/06 36/135
5,836,091 A * 11/1998 Cook ..... A43C 15/02 152/208
5,950,334 A * 9/1999 Gerhardt ..... A43B 5/18 36/59 R
5,987,783 A * 11/1999 Allen ..... A43B 5/001 36/102
6,029,377 A * 2/2000 Niikura ..... A43B 13/223 36/59 C
6,154,982 A * 12/2000 Bell ..... A43B 5/18 36/7.3
6,301,804 B1 * 10/2001 Battaglia ..... A43B 5/185 36/62
6,836,977 B2 * 1/2005 Larson ..... A43B 3/16 36/59 R
6,915,595 B2 * 7/2005 Kastner ..... A43C 15/02 36/59 C
7,165,343 B2 * 1/2007 Fukui ..... A43C 15/09 36/136
RE40,474 E * 9/2008 Quellais ..... A43B 13/12 36/107
7,428,788 B2 * 9/2008 Choi ..... A43C 15/063 36/59 R
8,256,140 B2 * 9/2012 Lagrand ..... A43C 15/02 36/62
2002/0029495 A1 * 3/2002 Kastner ..... A43C 15/02 36/59 R
2002/0095820 A1 * 7/2002 Giovale ..... A43C 15/061 36/7.6
2002/0189133 A1 * 12/2002 Parisotto ..... A43C 15/061 36/7.6
2003/0037461 A1 * 2/2003 Petzl ..... A43C 15/068 36/7.6
2004/0134102 A1 * 7/2004 Kastner ..... A43C 15/02 36/59 R
2004/0194346 A1 * 10/2004 Petzl ..... A43C 15/068 36/59 R
2006/0156577 A1 * 7/2006 Choi ..... A43C 15/063 36/7.6
2006/0254090 A1 * 11/2006 Baxter ..... A43C 11/1493 36/59 R
2007/0163148 A1 * 7/2007 Laporte ..... A43C 15/08 36/61
2007/0227039 A1 * 10/2007 Chaney ..... A43B 5/08 36/15
2008/0148601 A1 * 6/2008 Lefgren ..... A43C 15/16 36/65
2008/0184591 A1 * 8/2008 Chang ..... A43B 3/16 36/7.1 R
2010/0058615 A1 * 3/2010 Couder ..... A43C 15/02 36/62
2010/0139118 A1 * 6/2010 Park ..... A43B 5/001 36/7.6
2011/0047829 A1 * 3/2011 Bell ..... A43B 5/18 36/134
2011/0258878 A1 * 10/2011 Jones ..... A43C 15/063 36/62
2013/0014409 A1 * 1/2013 Chouinard ..... A43B 5/08 36/59 R
2013/0333251 A1 * 12/2013 Taniguchi ..... A43B 5/02 36/30 R

OTHER PUBLICATIONS

Extended European Search Report dated in EP 14198694.3, dated Aug. 7, 2015.
The EPO Communication From Corresponding European Application No. 14198694.3, dated Jun. 15, 2016 (4 pages).

* cited by examiner

FOOTWEAR TRACTION DEVICES AND SYSTEMS AND MECHANISMS FOR MAKING DURABLE CONNECTIONS TO SOFT BODY MATERIALS

PRIORITY

This application claims priority to U.S. Provisional Application No. 61/917,345 filed Dec. 17, 2013. The entire text the above-referenced disclosure is specifically incorporated herein by reference without disclaimer.

FIELD OF INVENTION

One aspect of the disclosure generally concerns footwear or footwear accessory devices, systems, and methods for improving traction.

Another aspect of the disclosure generally concerns attachment mechanisms that are at least partially embedded into a surrounding body to which attachment is desired.

BACKGROUND OF INVENTION

Many attempts have been made to create devices that can be worn over footwear to help provide traction on slick or slippery surfaces, in snow, or on ice. Such designs are bulky underneath the foot, provide limited traction, are uncomfortable during use, do not stay in place on the footwear, and/or provide insufficient durability.

Many attempts have also been made to create durable connections to stretchy and/or elastomeric materials. These attempts have limited durability when no reinforcement is used, and previous attempts at reinforcement have proven to be ineffective at creating a durable solution when the stretchy material is stretched at the point of attachment.

SUMMARY OF THE INVENTION

One aspect of the present disclosure is directed toward a device that can be worn over footwear to provide traction, such as on slick or slippery surfaces, in snow, or on ice. Described embodiments include footwear accessory devices comprising at least one cleat that provides traction but does not add significantly to the profile of the footwear during use. Additionally, described embodiments include devices for dispersing the pressure transferred to the footwear sole by the cleat, devices for absorbing impulses and shocks experienced by the cleat, devices for comfortably and securely fitting a range of footwear, devices for effectively engaging multiple types of terrain, and systems for keeping the device securely in place on the footwear.

A footwear traction device of the present disclosure can comprise at least one traction member having a top surface, a bottom surface, and a periphery extending between the top surface and the bottom surface, the fraction member comprising at least one layered section having at least a bottom layer comprised of a first material and an adjacent layer disposed above the bottom layer comprised of a second material and at least one cleat comprising an upper portion and a lower portion, wherein said upper portion of the cleat is at least partially embedded within the bottom layer and at least a portion of said lower portion extends outward from the bottom surface, and wherein the first material is softer than the second material. In addition, the cleat can comprise a radially projecting flange that is embedded within the bottom layer. In various embodiments, the cleat can comprise a first end located in the upper portion, wherein the first end is spaced apart from the adjacent layer an amount of about 0.3 mm to about 3.0 mm. In various embodiments, the upper portion of the cleat is a stud holder comprising a first end and a second end, the holder at the first end having a radially projecting flange, and the holder at the second end defining a hole extending at least partially therethrough and configured to receive the lower portion of the cleat, the lower portion being a fraction stud. In various embodiments, the first material substantially occupies the space between the cleat's first end and the adjacent layer. In various embodiments, the hardness of the first material is in the range of about Shore 55A to about Shore 95A, or is within a corresponding range on a different scale. In various embodiments, the hardness of the second material is about at least Shore 40D, or has a similar minimum hardness on a different scale. In various embodiments, the fraction device can further comprise at least one upper cleat that protrudes from the top surface. In various embodiments, the upper cleat can be integral with the adjacent layer, such as integrally molded therewith. In various embodiments, the upper cleat can be disposed generally or directly above the cleat that extends from the bottom surface. In various embodiments, the traction device can further comprise a traction element that extends from the bottom surface. The traction element can be polymeric and integral with the bottom layer, such as integrally molded therewith. The polymeric traction element can be a surface projection surrounding a portion of the cleat. The traction element can be a stepped or sloped surface projecting feature. The fraction element can span a transverse dimension (transverse being generally parallel to the bottom surface) that is at least 3 times a transverse dimension of the lower portion of the cleat. In various embodiments, the traction device can comprise at least four connecting arms, each arm extending from the periphery of a traction member body and terminating at a distal end. In various embodiment, the four arms project from the periphery of the traction body to form an X-like pattern when the fraction member is in a flattened orientation. Stated another way, the four arms can project from the periphery of the traction body such that a point at the end of each connecting arm corresponds to a corner of a four-sided figure, such as a trapezoid or a rectangle when the traction member and connecting arms are in a flattened orientation. Each connecting arm comprises an attachment feature at or near the distal end that is configured to couple the connecting arms to a footwear securing member. In various embodiments, the footwear securing member comprises a footwear harness, such as an elastomeric band configured to fit around the footwear along an upper, front portion, a left side portion, a heel portion, and a right side portion. In various embodiments, the attachment feature on the connecting arm comprises a through-hole.

A further embodiment of a footwear traction device can comprise a first traction member in accordance with the present disclosure configured to extend along the underside of an item of footwear in the forefoot region and a second traction member in accordance with the present disclosure configured to extend along the underside of an item of footwear in the rearfoot region; and four connecting arms extending from the periphery of each traction member such that the four arms form an X-like outline as described above. Each connecting arm terminates at a distal end and comprises an attachment feature at or near the distal end. In various embodiments, two of the connecting arms of the first traction member are coupleable to two of the connecting arms of the second traction member such that two sets of coupled arms are formed. Moreover, each set of coupled connecting arms can be coupled by a connecting link. The connecting link can be a ring that extends through a hole in each connecting arm. The connecting link can further connect the connecting arms to the footwear securing member. In various embodiments, each set of coupled connecting arms are configured such that the angle formed by each set of coupled arms increases upon the application of tension to the traction device.

Another aspect of the present disclosure is directed toward an improved device and method of reinforcing an attachment feature on a stretchy material. Embodiments include a device comprising a stretch material and at least one anchored connecting body that works to reinforce the stretchy material at an area or areas where a connection to the stretchy material is required. Additionally the second part of the disclosure includes anchored connecting bodies geometrically configured to resist several different types of forces, devices for permanently anchoring the anchored connecting body to the stretchy material, devices for preventing the anchoring connecting body material from separating from the stretchy material, and devices for reinforcing a material or a portion of a material that would be subject to higher tension forces in a localized area of the material (e.g., across the front shoe portion).

A connecting body of the present disclosure can comprise a connecting hub having a proximal end, a distal end, and an intermediate section therebetween and a flange radially projecting from the connecting hub within the intermediate region, the flange having an outer edge and an interior region, the flange defining at least one, two, three, four, five or more apertures disposed within the interior region. In various embodiments, the material (e.g., a stretchy and/or elastomeric material) in which the connecting body can be embedded can be softer than the material of the connecting body. (The material in which the connecting body can be embedded is referred to herein as the surrounding material, recognizing that it does not completely surround the connecting body.) The connecting body, particularly the flange, serves to reinforce the surrounding material. In various embodiments, the flange is surrounded by a material and the material occupies or is continuous through the apertures. In various embodiments, the connecting hub comprises a thickness, defined by the distance between the proximal end and the distal end, that is at least 1.5 times, 2 times, 3 times, 4 times, 5 times, 6 times, or more the thickness of the flange. In various embodiments, the total cross-sectional area of the apertures can comprise at least 5%, 10%, 15%, 20%, 25%, or more of the cross-sectional area of the interior region, which includes the area of the apertures. In various embodiments, the total cross-sectional area of the apertures comprises up to 30% of the cross-sectional area of the interior region. In various embodiments, the reinforcing flange material is fused or intermixed along the interface with the surrounding material. In various embodiments, the outer lateral surface of the connecting hub can be at least partially surrounded by and bonded with the surrounding material. In various embodiments, the outer lateral surface of the connecting hub material along the outer lateral surface can be at least partially surrounded by and fused or intermixed along the interface with the surrounding material. In various embodiments, the hardness of the surrounding material can be in the range of about Shore A 25 to 65, or within a similar range on a different scale. In various embodiments, the hardness of the connecting hub material is about at least Shore A 70 or harder, or has a similar minimum hardness on a different scale. In various embodiments, the connecting hub comprises an attachment feature, such as the connecting body defining a through-hole, threaded or smooth. In various embodiments, the connecting hub comprises a cylindrical sleeve.

A connecting body of the present disclosure can also comprise a first connecting hub and a second connecting hub spaced apart from each other, each connecting hub having a proximal end, a distal end and an intermediate section therebetween; two flanges each radially projecting from the respective connecting hub within the respective intermediate region; and a bridge piece extending between and coupled to the flanges. In various embodiments, the toe bail reinforcement can have at least one of the flanges defining at least two apertures. In various embodiments, the flanges can be encapsulated by a soft body material. In various embodiments, the bridge can be partially or completely encapsulated by the soft body material. In various embodiments, the flanges and bridge piece are a unitary form. The connecting body can be used to reinforce a soft body material in an area subject to higher tension forces than other areas of the device.

A footwear traction device of the present disclosure can comprise a footwear securing member, such as a footwear harness, comprising a section comprising a material (referred to as the surrounding material) and having a top surface and a bottom surface and at least one connecting body comprising a second, less elastomeric material, the connecting body comprising a connecting hub defining or being coupled to an attachment feature configured to connect to an object, and a flange radially projecting from the connecting hub. The hub has a proximal end, a distal end, and an outer lateral surface. The hub and the flange are at least partially surrounded by the surrounding material. In various embodiments, the flange is encapsulated by and bonded with the surrounding material. In various embodiments, the flange has an outer edge and an interior region and comprises at least one, two, three, four, five, six, or more apertures within the interior region, with the surrounding material occupying or being continuous through the apertures. In various embodiments, the connecting arms of the traction members in accordance with the present disclosure are couplable to the footwear harness via the connecting hub of the connecting body. Such footwear securing members can in the same or different embodiments at least one integrated toe bail. The toe bail can be formed of the second material and can comprise a first connecting body and a second connecting body spaced apart from each other; and a bridge piece spanning the distance between and coupled to the two connecting body wherein each body extends at least partially between the top surface and the bottom surface of the footwear securing member. The bridge piece can be at least partially encapsulated by the first material.

The term "permanent" and phrases such as "permanently bonded," "permanently adhered," "permanently connected," "permanently coupled," and the like are defined to mean captive and/or non-releasable. In some embodiments but not necessarily all, two components that are permanently bonded could not be cleanly separated without degrading or destroying at least some of one of the materials.

The term "fused" is defined as a type of adhesion that is caused by the mixing of materials at the interface where two or more components interface. The materials can be the same or different.

The term "layer" can mean one layer of material or a plurality of layers of different or same materials.

The term "coupled" or "connected" is defined as connected, although not necessarily directly, and not necessarily mechanically. Two items are "couplable" if they can be coupled to each other, and, when coupled, may still be characterized as "couplable." Unless the context explicitly requires otherwise, items that are couplable are also decouplable, and vice-versa. One non-limiting way in which a first structure is couplable to a second structure is for the first structure to be configured to be coupled (or configured to be couplable) to the second structure.

The terms "a" and "an" are defined as one or more unless this disclosure explicitly requires otherwise.

The terms "substantially," "approximately" and "about" are defined as being largely but not necessarily wholly what is specified (and include wholly what is specified) as understood by one of ordinary skill in the art. In any disclosed embodiment, the term "substantially," "approximately," or "about" may be substituted with "within [a percentage] of" what is specified, where the percentage includes 0.1, 1, 5, and 10 percent.

The preposition "between," when used to define a range of values (e.g., between x and y) means that the range includes the end points (e.g., x and y) of the given range and the values between the end points.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, any of the present devices, systems, and methods that "comprises," "has," "includes" or "contains" one or more elements possesses those one or more elements, but is not limited to possessing only those one or more elements. Likewise, an element of a device, system, or method that "comprises," "has," "includes" or "contains" one or more features possesses those one or more features, but is not limited to possessing only those one or more features. Additionally, terms such as "first" and "second" are used only to differentiate structures or features, and not to limit the different structures or features to a particular order.

Furthermore, a structure that is capable of performing a function or that is configured in a certain way is capable or configured in at least that way, but may also be capable or configured in ways that are not listed. Metric units may be derived from the English units provided by applying a conversion and rounding to the nearest 0.1 millimeter.

The feature or features of one embodiment may be applied to other embodiments, even though not described or illustrated, unless expressly prohibited by this disclosure or the nature of the embodiments.

Any of the present devices, systems, and methods can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure may not be labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION OF THE EMBODIMENTS

Figure 1:
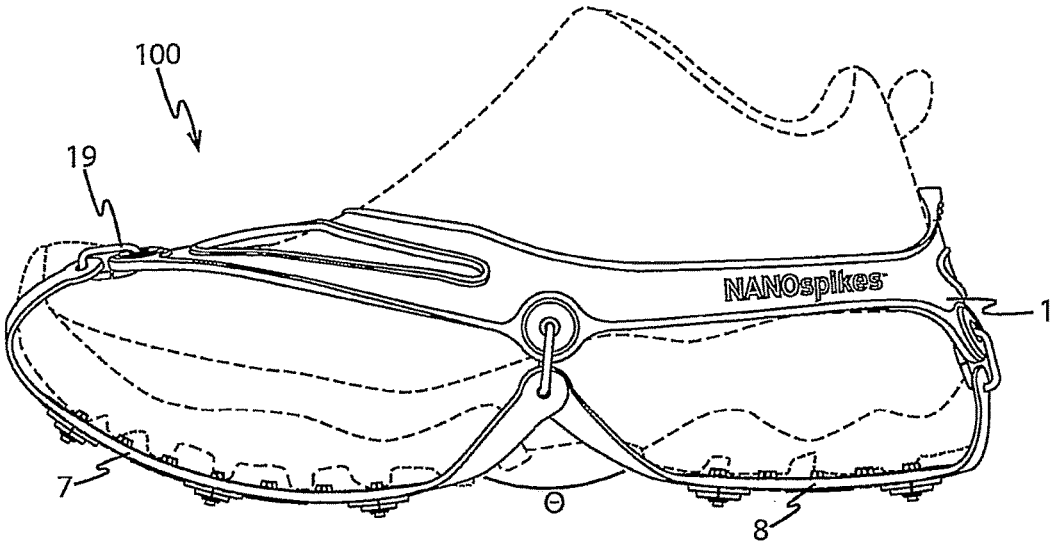
FIG. 1 illustrates a side view of an embodiment of a footwear traction accessory having a plurality of traction members, specifically a forefoot traction member and a rearfoot traction member, connected to a footwear securing harness via connecting links, shown fitted onto a shoe
Figure 2:
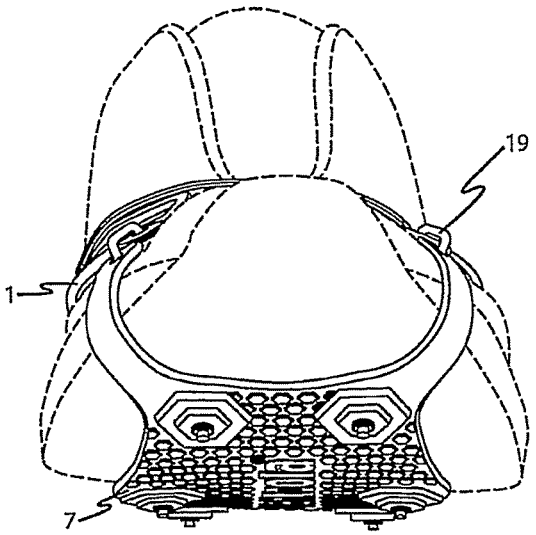
FIG. 2 illustrates a front view of the embodiment shown in FIG. 1.
Figure 3:
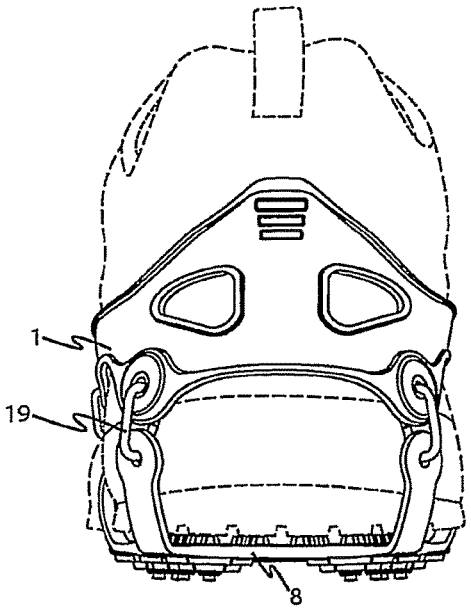
FIG. 3 illustrates a rear view of the embodiment shown in FIG. 1.
Figure 4:
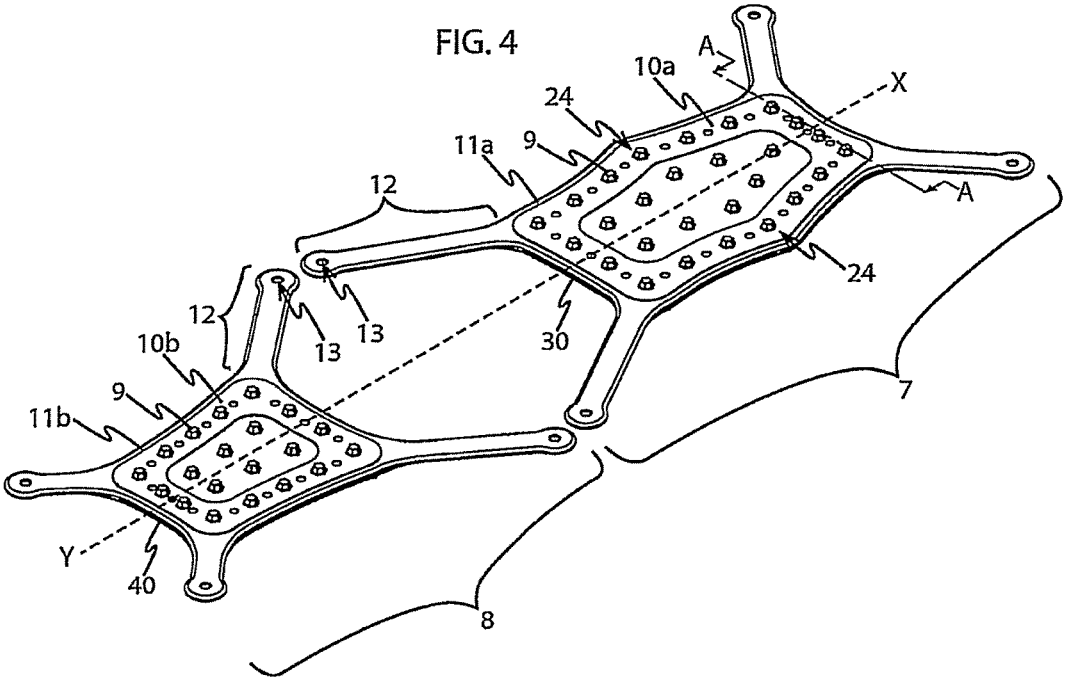
FIG. 4 illustrates a top perspective view of two traction member embodiments, specifically a forefoot fraction member (right) and a rearfoot fraction member (left).
Figure 5:
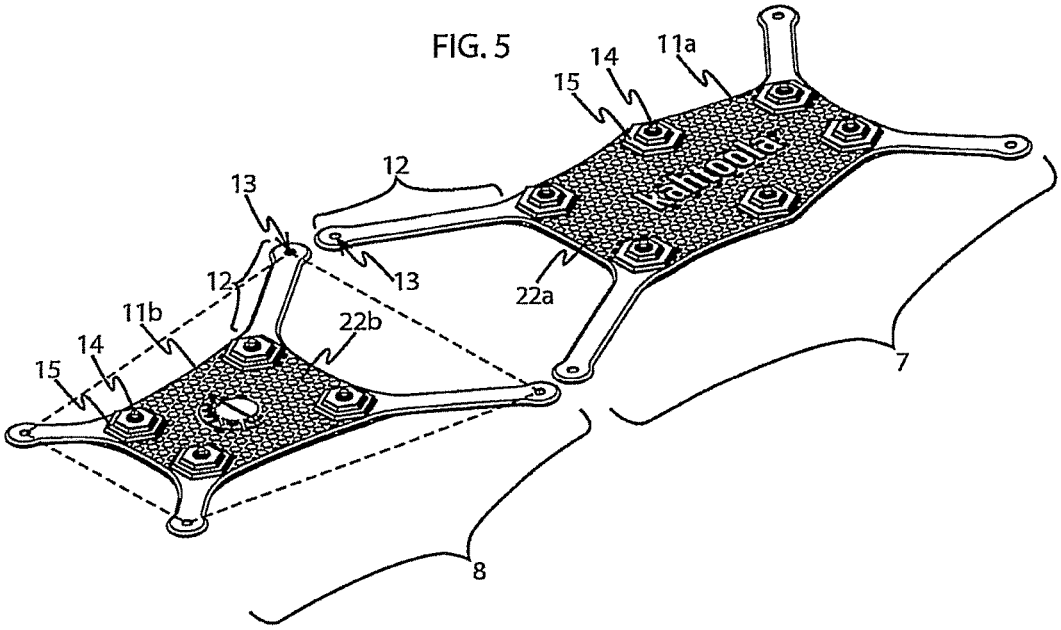
FIG. 5 illustrates a bottom perspective view of the fraction member embodiments shown in FIG. 4.
Figure 6:
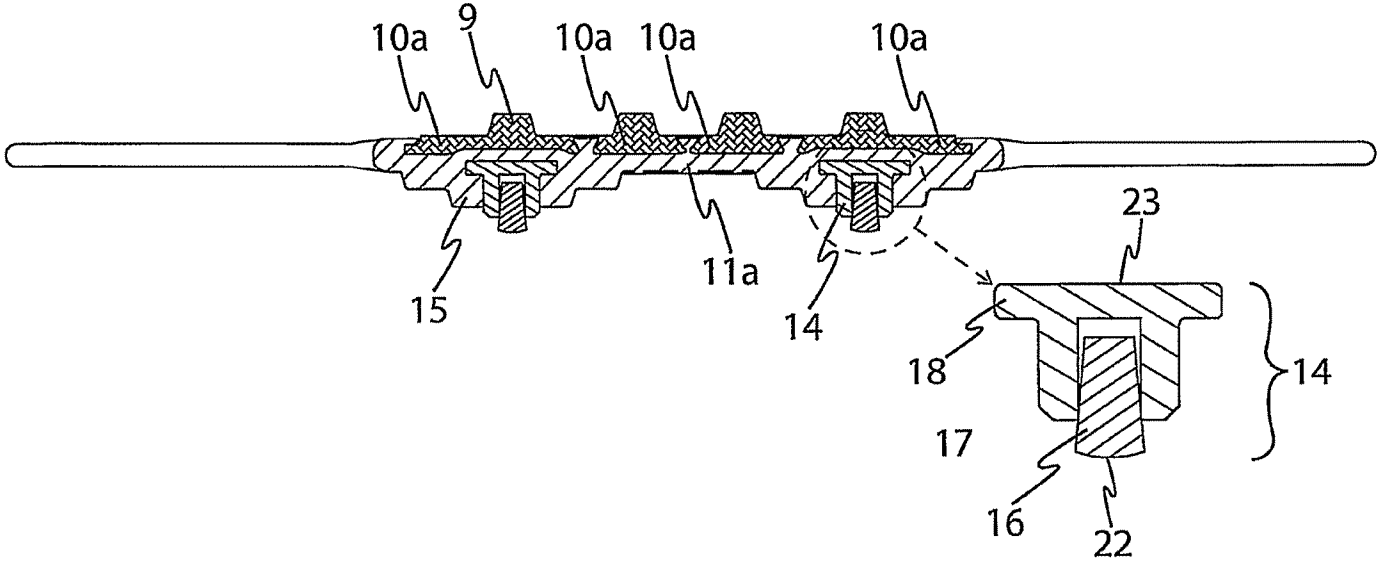
FIG. 6 illustrates a cross-section view of the body portion of a traction member embodiment along line A-A of FIG. 4, and includes an enlarged cross-section detail view of the cleat of the traction member.
Figure 7:
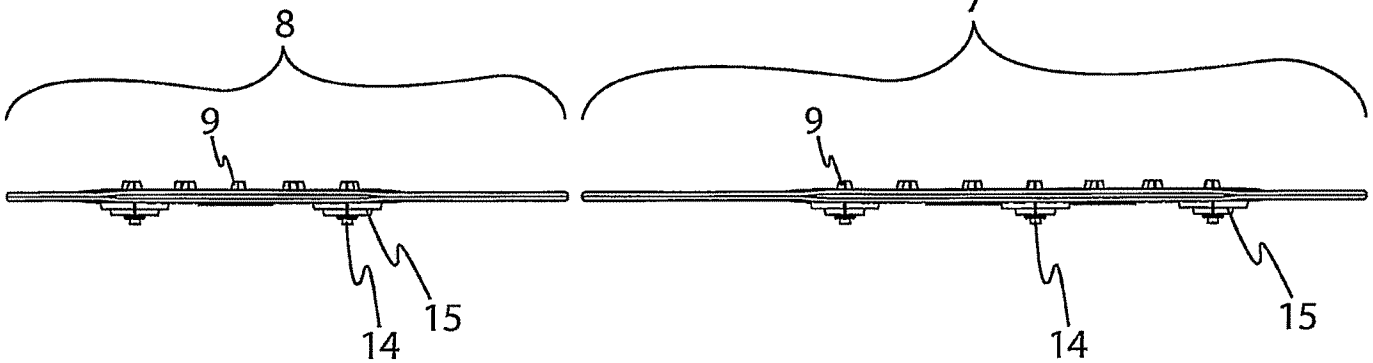
FIG. 7 illustrates a side view of the traction member embodiments shown in FIG. 4.
Figure 8A:
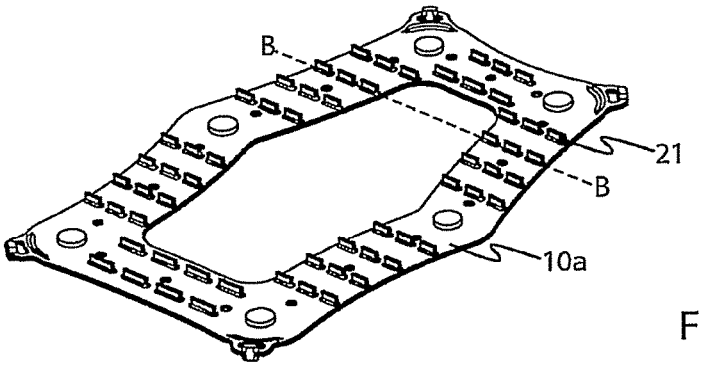
FIGS. 8*a* and 8*b* illustrates a bottom perspective view of embodiments of the components that form the adjacent layer of a traction member. The surface that interfaces with the bottom layer is visible.
Figure 8B:
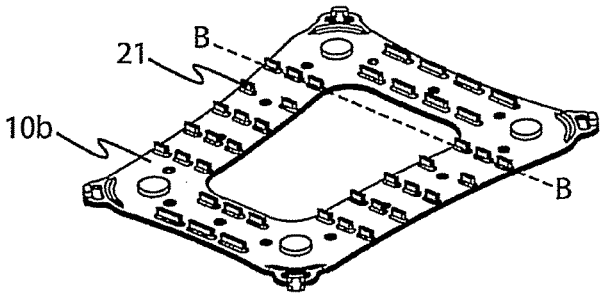
Figure 9A:
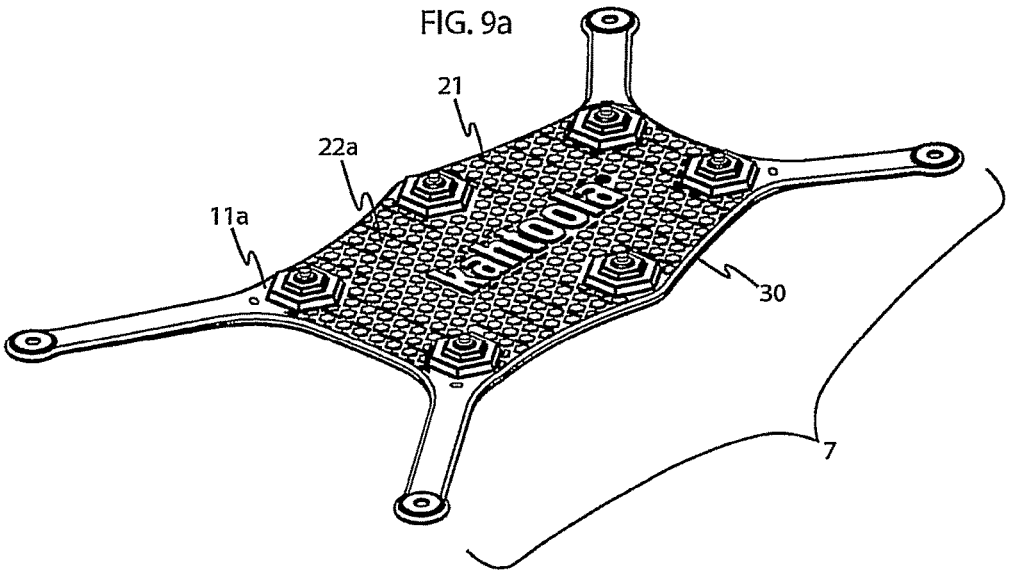
FIGS. 9*a* and 9*b* illustrates a bottom perspective view of traction member embodiments, specifically, a forefoot traction member and a rearfoot traction member, respectively, incorporating the components shown in FIGS. 8*a* and 8*b*.
Figure 9B:
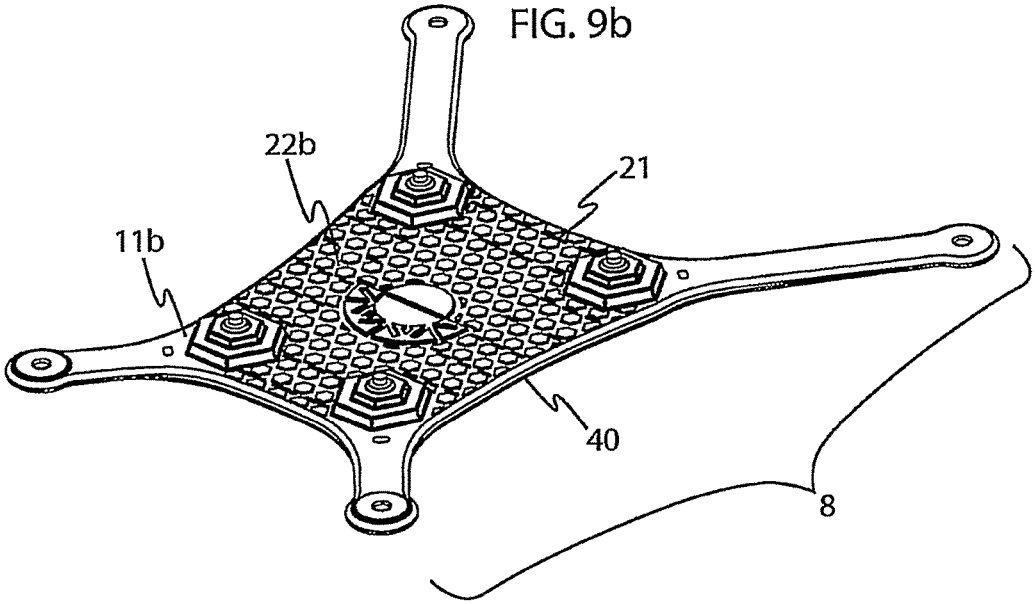
Figure 10:
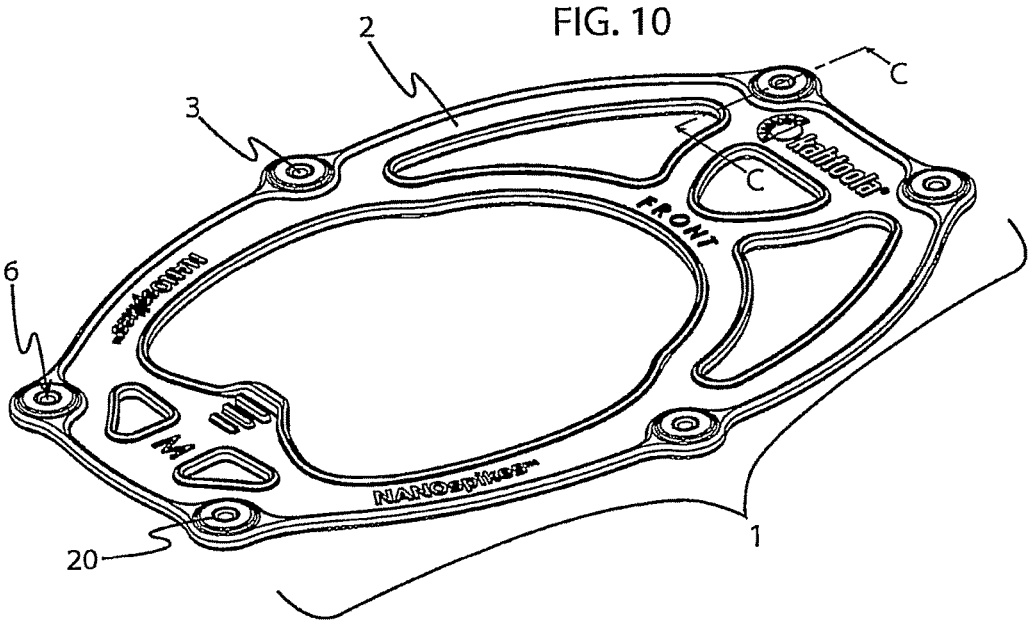
FIG. 10 illustrates a top perspective view of an embodiment of a footwear securing harness.
Figure 11:
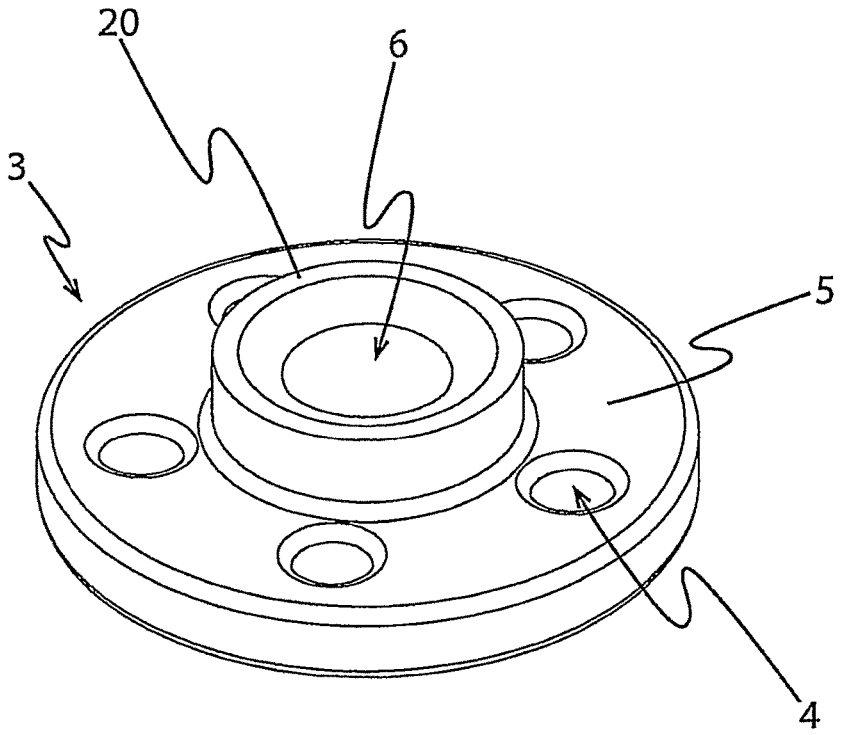
FIG. 11 illustrates a perspective view of an embodiment of a connecting body.
Figure 12:
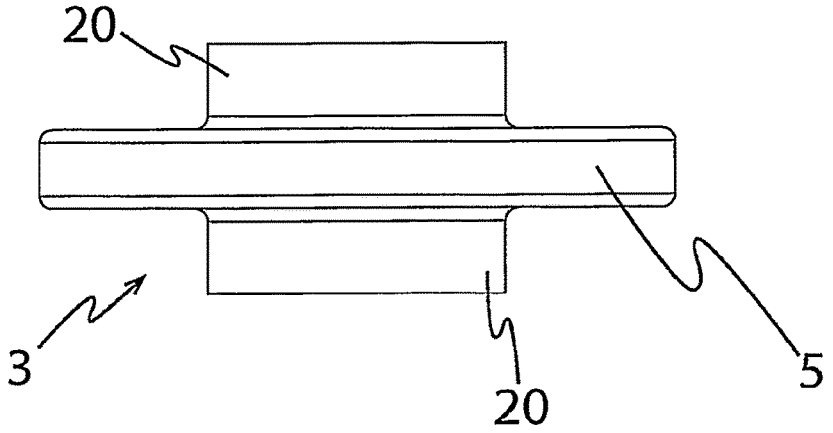
FIG. 12 illustrates a side view of the embodiment shown in FIG. 11.
Figure 13:
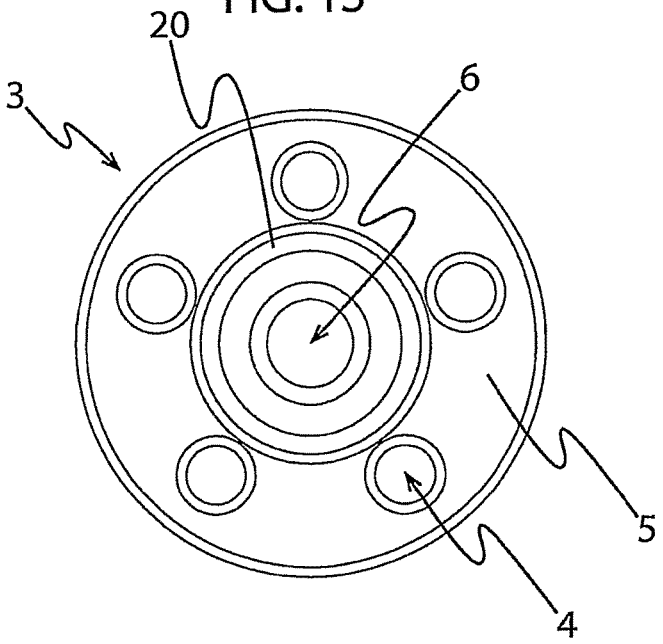
FIG. 13 illustrates a top view of the embodiment shown in FIG. 11.
Figure 14:
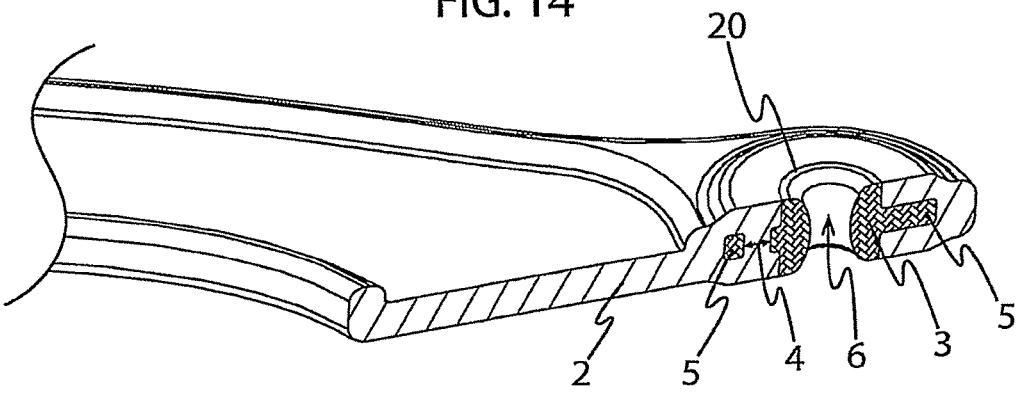
FIG. 14 illustrates a partial perspective cross-section view of a footwear securing harness embodiment and an anchored connecting body embodiment along line C-C of FIG. 10, demonstrating the elements interfacing with one another, and how the material of the footwear securing harness is continuous through an aperture in the flange of the anchored connecting body.
Figure 15A:
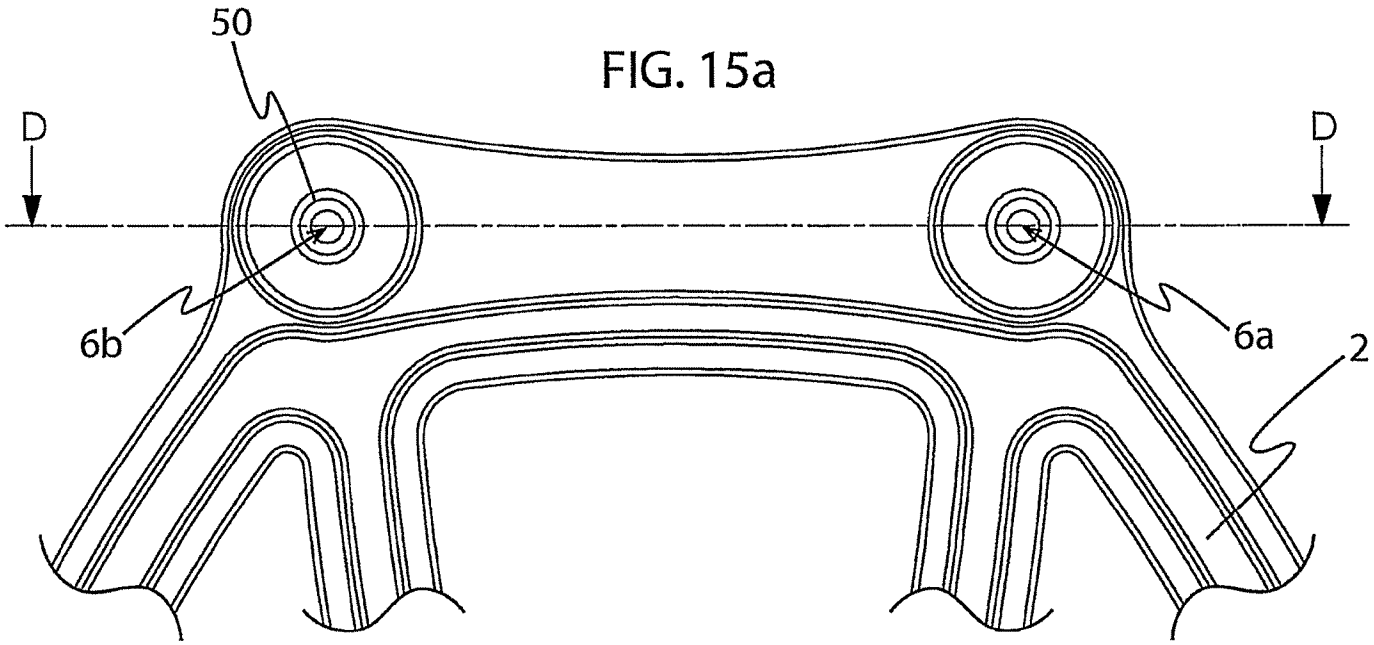
FIG. 15*a* illustrates a top view of the front portion of a footwear securing harness embodiment with a bridged connecting body serving as an integrated toe bail.
Figure 15B:
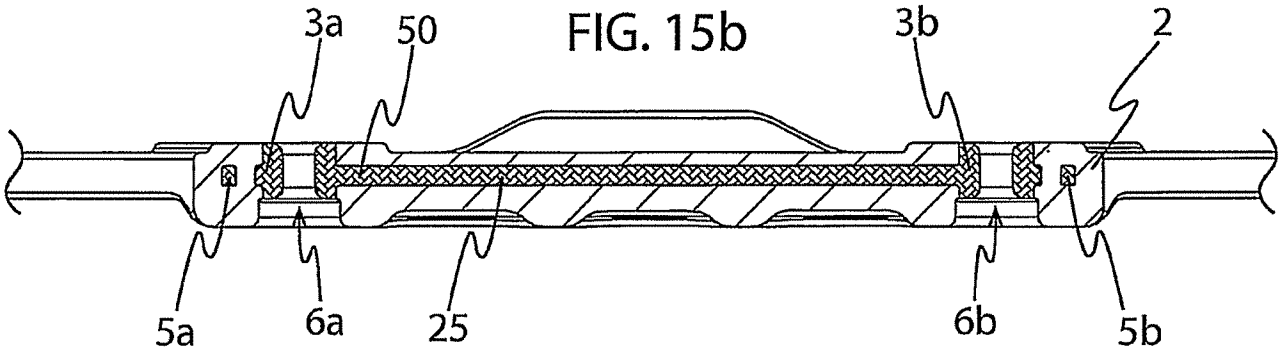
FIG. 15*b* illustrates a cross-section view of the embodiment shown in FIG. 15*a*, along line B-B.
Figure 15C:
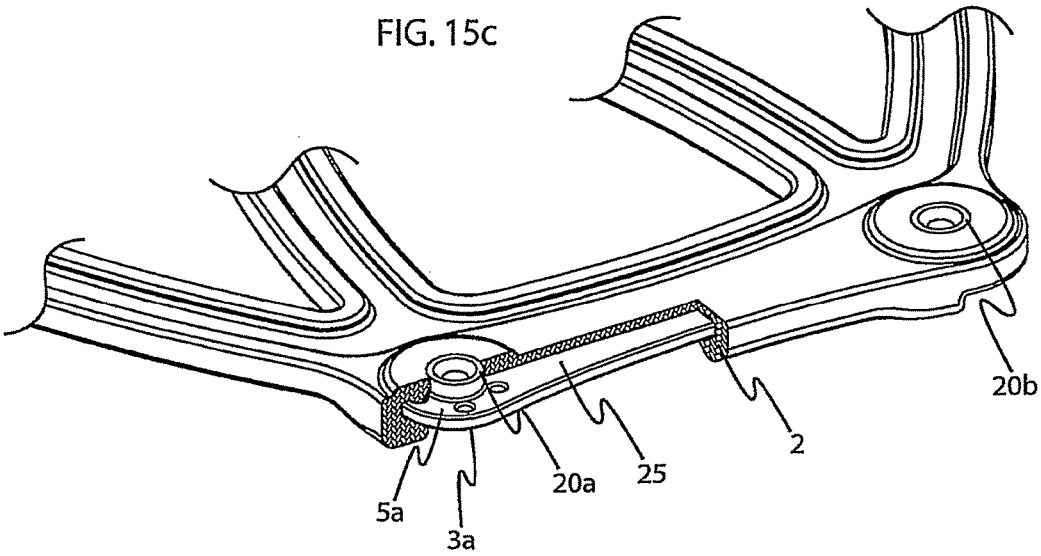
FIG. 15*c* illustrates a cut-away, perspective view of the embodiments shown in FIG. 15*a*, with the surrounding, elastomeric material removed to expose the bridged connecting body.
Figure 15D:
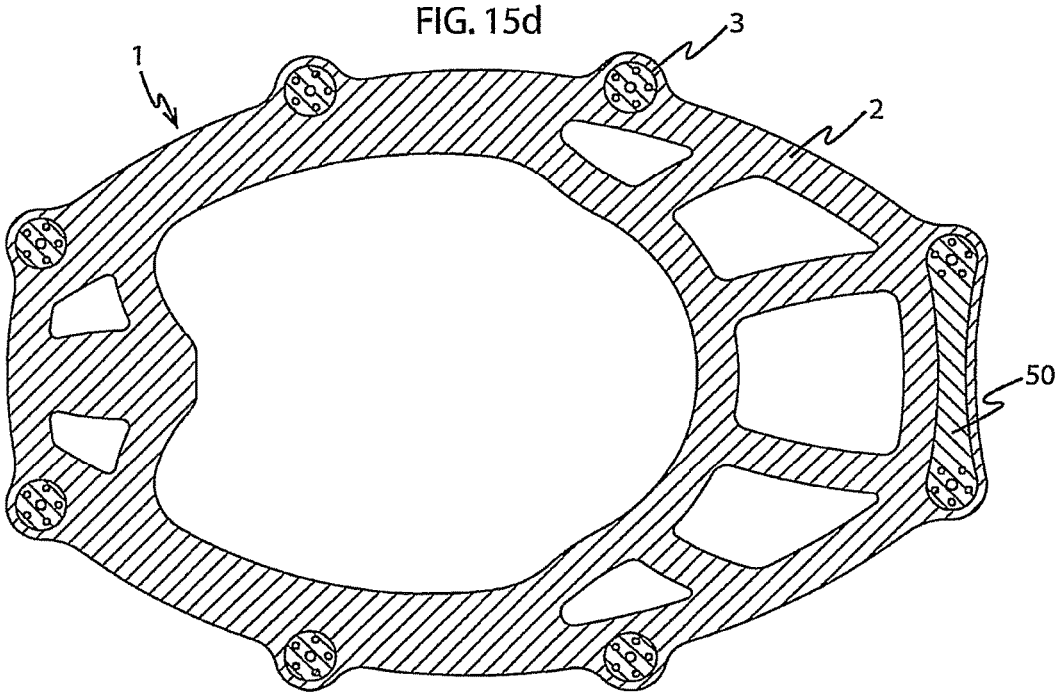
FIG. 15*d* illustrates a cross-section, top view of a footwear securing harness embodiment with a bridged connecting body that is located in the front portion, as shown in FIG. 15*a*.
Figure 16A:
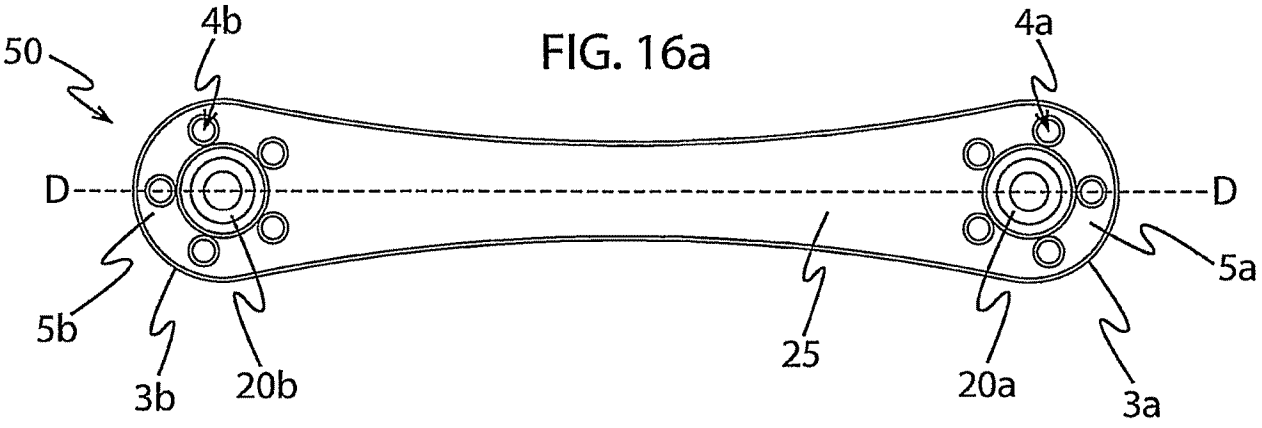
FIG. 16*a* illustrates a top view of a bridged connecting body embodiment.
Figure 16B:
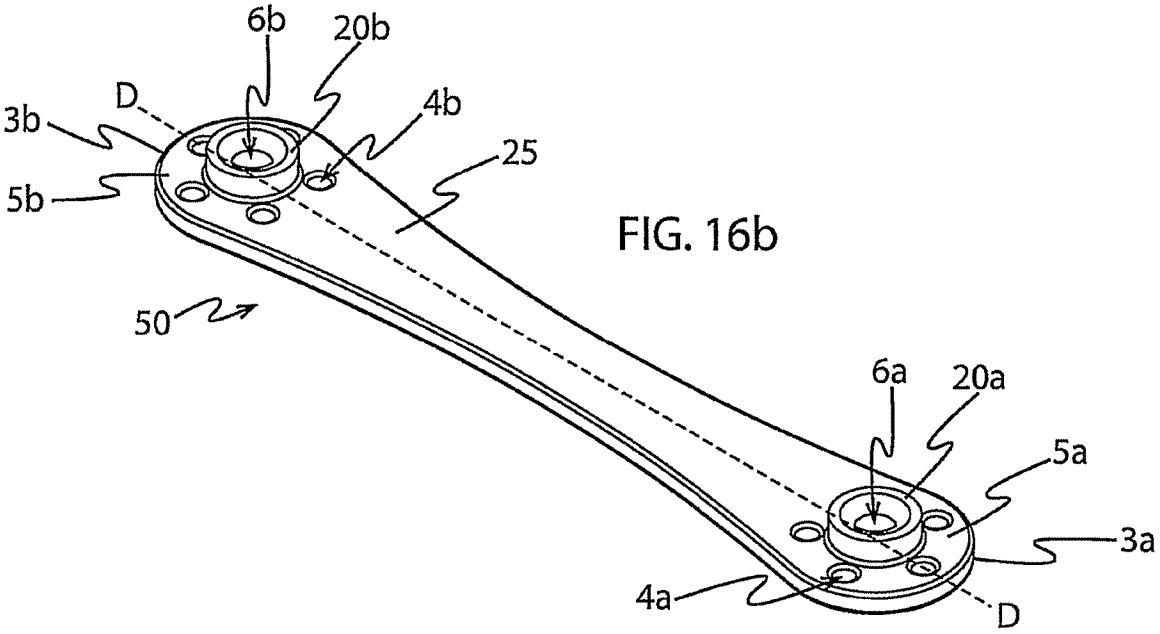
FIG. 16*b* illustrates a top, perspective view of the embodiment shown in FIG. 16*a*.

The following description is directed to a low-profile device to provide fraction with a surface, such as, on ice, snow, and other slick or slippery terrain. An embodiment of a device in accordance with the present disclosure is illustrated in FIGS. 1 to 3. As shown, such devices 100 can comprise at least one footwear securing member 1 couplable to at least one traction member 7 or 8. For example, in various embodiments, at least one connecting link 19 can be configured to couple the footwear securing member 1 to the traction member 7 or 8.

With reference to FIGS. 4 to 7, a traction member 7 or 8 can comprise a traction body 30, 40 that contains at least one layered section that comprises a bottom layer 11*a*, 11*b* (such as the bottommost layer) and a layer 10*a*, 10*b* adjacent the bottom layer (i.e., the adjacent layer 10*a*, 10*b*). In various embodiments, the adjacent layer 10*a*, 10*b* can be a first pressure dispersing layer and/or a reinforcement layer. In various embodiments, the bottom layer 11*a*, 11*b* can be at least one force absorption layer. For example, in various embodiments, the bottom layer 11*a*, 11*b* comprises a material that is softer than the adjacent layer 10*a*, 10*b*. These two layers can be adhered and/or bonded to one another in order to form a section that has a flexible absorption zone as well as a stiffer, pressure-dispersing and/or reinforcing zone.

Within the layered section of body 30, 40, the traction member 7 or 8 comprises at least one cleat 14, such as 1, 2, 3, 4, 5, or more cleats 14. A portion of the cleat 14 is embedded within the bottom layer 11*a*, 11*b* to anchor the cleat 14 and another portion of the cleat 14 extends outward from the bottom surface of the bottom layer 11*a*, 11*b* to provide traction.

In various embodiments, the cleat 14 is a body comprising a hard material, such as tungsten carbide, and configured at a second end 22 to provide traction with a terrain, such as a slick or slippery surface. In various embodiments, the cleat 14 at the first end 23 is configured to anchor into bottom layer 11*a*, 11*b*. For example, the cleat 14 can comprise a radially projecting flange 18 at the second end that is at least partially embedded within the bottom layer 11*a*, 11*b*. The mechanical interlock between the flange 18 and the bottom layer 11*a*, 11*b* can facilitate the permanence of the cleat 14 within the bottom layer 11*a*, 11*b*. Therefore, in various embodiments, the cleat 14 can be a permanent sub-component of the traction member 7 or 8.

In various embodiments, the bottom layer 11*a*, 11*b* is adjacent to and underneath the adjacent layer 10*a*, 10*b*. In some embodiments, the bottom layer 11*a*, 11*b* defines the bottom surface of the traction member 7 or 8. In some embodiments, the adjacent layer 10*a*, 10*b* defines the top surface of the traction member 7 or 8.

Further, in various embodiments, the uppermost surface of the cleat 14 is spaced apart from the adjacent layer 10*a*, 10*b* and therefore the upper portion of cleat 14, including, at least in some embodiments, the flange 18, is completely embedded within the bottom layer 11*a*, 11*b*. The material of the bottom layer 11*a*, 11*b* surrounding the upper portion of the cleat 14 functions as a shock absorber for the cleat 14, helping it to absorb shock and impulses of force. In various embodiments, the space between the uppermost surface of the cleat 14 and the adjacent layer 10*a*, 10*b* can be any amount between 0.1 to 5 mm, such as 0.1 mm, 0.2 mm, 0.3 mm, 0.4 mm, 0.5 mm, 0.6 mm, 0.7 mm, 0.8 mm, 0.9 mm, 1 mm, 2 mm, 3 mm, 4 mm, or 5 mm. In various embodiments, the bottom layer 11*a*, 11*b* can be of 1 mm to 6 mm. In other embodiments, the uppermost surface of the cleat 14 is adjacent to or in contact with the adjacent layer 10*a*, 10*b* and the upper portion is embedded within the bottom layer 11*a*, 11*b* except along the uppermost surface contacting the adjacent layer 10*a*, 10*b*.

Further, in various embodiments, said cleat 14 can comprise two sub-components. The first sub-component can comprise a stud holder 17 that comprises flange 18 on one end, and a hole on the opposite end that extends at least partially through the stud holder 17. Said hole is configured to receive the second sub-component, stud 16. Such arrangement allows different materials to be used in the construction of the cleat 14, which can be favorable, e.g., when the stud 16 is desired to be made of a hard first material, such as tungsten carbide, and the stud holder 17 is desired to be made of a different lighter weight second material, such as titanium or aluminum.

Alternatively, in other embodiments, said cleat 14 can be integrally formed, wherein the cleat 14 can be a single piece and comprise the same features as the two piece design described above. Such arrangement is favorable, for example, when ease of manufacturing is a more important factor than weight.

Further, a traction member 7 or 8 can also comprise at least one upper surface cleat 9 that is configured to provide traction with the sole of a user's footwear, and can further be configured to mechanically interlock with the sole during use. Additionally, said upper surface cleat 9 can be placed generally or directly above the bottom surface cleat 14, such that an upward force upon the bottom surface cleat 14 will be transferred through all components in the traction member 7 or 8 and focused into the upward facing cleat 9 that can provide a counter-force when upper surface cleat 9 contacts the sole. Such configuration can also facilitate the upper surface cleat 9 having an enhanced engagement with the sole of a user's footwear, and thus, improved traction. Additionally, the placement of an upper surface cleat 9 directly over the top of a cleat 14 is favorable to help reduce any flexing of the adjacent layer 10*a*, 10*b* that would be created by an upper surface cleat 9 positioned not generally above cleat 14.

Further, a traction member 7 or 8 can also comprise at least one traction element 15 that protrudes from the bottom surface 22*a*, 22*b*. In various embodiments, traction element 15 can be comprised of the same material as the bottom layer 11*a*, 11*b*, e.g., a polymeric material softer than the adjacent layer 10*a*, 10*b*, and can be integrally molded with the bottom layer 11*a*, 11*b*. Additionally, the traction element 15 can be positioned around the cleat 14 and can be configured to help minimize or prevent the tilting of the axis of the cleat 14 and/or provide a different type of fraction around the area where the cleat 14 is situated. For example, traction element 15 can be stepped or have a sloping surface protrusion that can provide additional edges to effectively engage terrain. Such a configuration can help minimize or prevent the tilting of the axis of the cleat 14.

Further, the traction member 7, 8 can further comprises at least one connecting arm 12 configured to couple the fraction member to the footwear securing member 1 and/or another traction member 7, 8. The connecting arm 12 can integral with or coupled to the traction body portion 30, 40 of traction member 7, 8. In some embodiments, the material of the bottom layer 11*a*, 11*b* is the same as the connecting arm 12 and can further be integrally molded. The connecting arm 12 can comprises an attachment feature configured to facilitate coupling to the footwear securing member 1 and/or another connecting arm of a second traction member 7, 8. An example of an attachment features is a hole 13 defined by the connecting arm 12 that is closer to the terminating end of the connecting arm than the end coupled to the traction body portion 30, 40. In addition, in various embodiments, a connecting arm 12 is couplable to both another connecting arm 12 as well as to the footwear securing member 1 via an attachment feature (e.g., hole 6 and link 19), thereby coupling three components to each other. For example, a link 19 can be configured to couple the connecting arm 12 to the footwear securing member 1 and/or to couple the connecting arm 12 to another connecting arm 12. Link 19 would could through a hole defined by the securing member 1 and in each of the two connecting arms 12. In various embodiments, the link 19 can extend through the holes 13 of the coupled connecting arms 12 such that the holes 13 are substantially coaxial. The connecting arms 12 can be reinforced around hole 13. FIG. 1 illustrates an embodiment where two connecting arms 12 and footwear securing member 1 are coupled by the link 19 on a lateral side of a shoe, which is shown in dashed lines.

In various embodiments, a front traction member 7 can comprise a body member 30 configured to extend along the underside of an item of footwear in the forefoot region and at least four connecting arms 12. The four connecting arms 12 are arranged to have an X-like shape when the traction member 7 is in a flattened orientation. Similarly, in various embodiments, a rear traction member 8 can comprise a body member 40 configured to extend along the underside of an item of footwear in the rearfoot region and at least four connecting arms 12. The four connecting arms are also arranged to have a similar X-like shape when the traction member 8 is in a flattened orientation. In other words, the four connecting arms 12 are spaced apart from each other and extend away from the traction body portion 30, 40 such that a point at the attachment feature (e.g., hole 13) of each connecting arm corresponds to a corner of a four-sided figure, such as a trapezoid or a rectangle (see dashed outline on FIG. 5) when the traction member 7, 8 is in a flattened orientation. The frontmost two connecting arms 12 of the front traction member 7 wrap over the toe of the user's footwear and connect to the footwear securing member 1, such as at the connecting body 3 through the hole 6 via connecting links 19. Similarly, the rearmost two connecting arms 12 of the rear traction member 8 wrap over the heel of the user's footwear and connect in the same fashion. The left rearmost connecting arm 12 of the front traction member 7 and the left frontmost connecting arm 12 of the rear fraction member 8 couple to one another, and also to the footwear securing member 1 at the connecting body 3 through the connection hole 6 via a link 19. The corresponding connecting arms 12 on the right side can be coupled in the same manner.

The beneficial aspect of this embodiment is that one size of a traction device 100 can fit a range of footwear sizes. For example, a medium size traction device might fit from a women's size 8 to a men's size 10. Accordingly other sizes of traction devices could be offered that would fit other ranges of footwear in order to accommodate users with footwear sizes outside of the range of the medium size. With reference to FIGS. 1 and 4-7, this can be accomplished since the angle Θ (shown in FIG. 1) between the rearmost connecting arms 12 of the front traction member 7 and the frontmost connecting arms 12 of the rear traction member 8 can be pivotably varied. For example, when a size medium fraction device is placed on women's size 8 footwear, the angle Θ between said connecting arms 12 coupled to one another will be relatively small, thus allowing the traction members 7 and 8 to remain relatively close to one another. If the same size medium traction device is placed on men's size 10 footwear, the angle Θ between said connecting arms 12 coupled to one another will be relatively large, thus allowing the traction members 7 and 8 to be further apart to accommodate larger sizes of footwear. This flexibility in size is facilitated by the connection created between the connecting arms 12 to one another, as well as to the elastomeric footwear securing member 1 (e.g., a footwear securing harness or elastomeric harness). In this configuration, the bisector of the angle Θ created by the two connecting arms 12 that are connected to one another is pulled in the general opposite direction of the pointing direction of the angle Θ bisector by the tension of stretchy footwear securing member 1. This tension allows users of a range of footwear sizes to comfortably wear the same size traction device while still maintaining a secure fit.

Suitable materials for the adjacent layer 10*a*, 10*b* can be plastic, rubber, thermoplastic polyurethane, metal, wood, or any material harder than the material used for the bottom layer 11*a*, 11*b*. Suitable materials for the bottom layer 11*a*, 11*b* can be plastic, rubber, thermoplastic polyurethane, thermoplastic elastomer, foam, or any flexible and durable material. Suitable materials for the stud 16 can be material harder than the bottom layer 11*a*, 11*b* and/or the adjacent layer 10*a*, 10*b*, like a metal such as steel, titanium, or the like, or a substantially hard material such as tungsten carbide, or the like. Suitable materials for the stud holder 17 can be metal such as steel, aluminum, titanium, or the like, or a substantially hard plastic, polymer, or the like. Suitable materials for an integrally formed cleat 14 can be metal such as steel, aluminum, titanium, or the like, or a substantially hard material such as tungsten carbide, or the like. In an embodiment, the adjacent layer 10*a*, 10*b* can be injection molded from thermoplastic polyurethane, and the bottom layer 11*a*, 11*b* can be injection molded from a softer thermoplastic polyurethane. The cleat 14 can be made from the combination of a stud 16 made from tungsten carbide and a stud holder 17 made from aluminum. The bottom layer 11*a*, 11*b* can be molded over the adjacent layer 10*a*, 10*b*, as well as the cleat 14 during manufacturing of the traction member 7 or 8.

In various embodiments, a traction member 7 or 8 can define a low profile. For example, the thickness of traction member 7 or 8 at the location of cleat element 14 as measured from the top surface of the traction member 7 or 8 to the distal end of stud 16, the thickness can be within a range of 3 mm to 13 mm, such as 3 mm, 4 mm, 5 mm, 6 mm, 7 mm, 8 mm, 9 mm, 10 mm, 11 mm, 12 mm, or 13 mm. On a section of the traction member 7 or 8 with no cleat or fraction elements, the thickness can be within a range of 2 mm and 5 mm. In an embodiment comprising upward facing cleat 9 generally above cleat 14, the thickness of traction member 7 or 8 in that location can be within a range of 4 mm to 15 mm.

In various embodiments, the traction member 7, 8 can have a structurally weaker intermediate region 24 to allow the member to conform more so to the sloped outline of a shoe sole. For example, the adjacent layer 10*a*, 10*b* and/or the bottom layer 11*a*, 11*b* can be thinner in this intermediate region or a softer material than in the other regions within the same layer. As another example, there could be a region 24 where the harder material (e.g., the material forming the adjacent layer 10*a*, 10*b*) is not present, essentially discontinuance in the layering with only a softer less rigid material (e.g., the material forming the bottom layer 11*a*, 11*b*) in that region. In some embodiments, the region is oriented lengthwise in a direction transverse to longitudinal or lengthwise axis X-Y.

In various embodiments, the adjacent layer 10*a*, 10*b* can comprise elements that aid in the manufacturing process. For example, the components that form the adjacent layer 10*a*, 10*b* can comprise a surface projection that facilitates the proper positioning of the component in a traction member mold. Such projections can be disposed on the surface that will ultimately be adhered and/or fused with the bottom layer 11*a*, 11*b*. In the illustrated embodiments shown in FIGS. 8*a* to 8*b* and 9*a* to 9*b*, examples of such projections are fins 21 that project from one or both layers (e.g., the adjacent layer 10*a*, 10*b* as shown and/or bottom layer 11*a*, 11*b*) and extend into the neighboring layer (e.g., the bottom layer 11*a*, 11*b* as shown and/or adjacent layer 10*a*, 10*b*). More particularly, the plurality of fins 21 unitary with the adjacent layer 10*a*, 10*b* can project from the surface that faces the bottom layer 11*a*, 11*b* and extend into the bottom layer 11*a*, 11*b*.

The plurality of fins 21 can be oriented in any pattern relative to each other. In various embodiments, the plurality of fins 21 are oriented such that a lengthwise axis of each one of the fins is substantially parallel to the other fins. In various embodiments, the plurality of fins 21 can extend lengthwise in a direction that is substantially transverse to the longitudinal or lengthwise axis X-Y of the traction member body 30, 40 or aligned with an axis about which the body bends during use (e.g., an axis substantially parallel to line A-A).

The fins 21 should have sufficient column strength to maintain the position of the adjacent layer component in the mold but is dimensioned and oriented to not detrimentally impact the material integrity of the bottom layer 10*a*, 10*b* and/or not detrimentally block the flow of the softer material during the injection molding process. In various embodiments, a fin 21 can have a length (or in the direction of line B-B) that is between 1 mm to 1 cm, such as 1 mm, 2 mm, 3 mm, 4 mm, 5 mm, 6 mm, 7 mm, 8 mm, or 9 mm. The fins 21 can extend substantially normal to the surface of the adjacent layer 10*a*, 10*b*. The plurality of fins 21 can be spaced apart from each other but aligned with each other to extend along the same axis (e.g., line B-B). The amount of space between a set of ends of the aligned fins 21 can be greater than 20% of the dimension neighboring fin, such as 20% to 500%. Fin 21 are one type of surface projection that can facilitate adhesion by increasing the contact surface area between the two layers 10 and 11. Other surface projection shapes can include a post. Alternatively, the adjacent layer 10*a*, 10*b* surface that interfaces with bottom layer 11*a*, 11*b* may be textured.

With reference to FIG. 9, a footwear securing member 1 can further comprise a stretchy or elastomeric main body 2 (e.g., an elastomeric harness) of a first softer material and at least one anchored connecting body 3 of a second harder material that provides reinforcement at specific areas of the stretchy main body 2 that require connection to other components, where the stretchy main body 2 is permanently bonded to the anchored connecting body 3 in order to form one completed component that is mainly stretchy but is also reinforced and strong where forces are focused due to connections to other components. Such an arrangement is favorable because the stretchy main body 2 is very effective at securing a range of sizes of footwear, is quick and easy to put onto the footwear, and is convenient for the user because no straps, buckles, or other the like are required to keep the footwear secure due to the elasticity inherent in the stretchy band; however, the material that comprises the main stretchy body 2 is not ideal for connecting to other components, as localized forces and stresses on the stretchy material can result in a tear at the connection point. The use of an anchored connecting body 3 of the said second harder material that is able to better retain its form when forces are experienced allows the forces from the connection to be dispersed across a larger area of the stretchy main body 1, thereby eliminating the localization of the forces from the connection.

Further, there are several novel mechanisms that contribute to the effectiveness of said configuration. For example, if a simple grommet is used in combination with a stretchy main body 2 in an attempt to provide reinforcement, the grommet will eventually separate from the stretchy main body 2. This can happen easily since said stretchy material will easily change form when stretched, thereby eventually resulting in a separation of a simple grommet from the stretchy main body 2. One said simple grommet is separated from the stretchy main body 2, the forces are once again localized to a specific point on the stretchy main body 2 and the localized forces on the said first softer material can cause a failure in the material. The anchored connecting body 3 of this embodiment can be thought of as an improved grommet to prevent such failures and includes several features for creating an improved grommet to be used for reinforcing connections to stretchy materials.

With reference to FIGS. 10 to 14, in accordance with another aspect of the present disclosure, the connecting body 3 can be configured to anchor into a surrounding material. For example the connecting body 3 can comprise a connecting hub 20 configured to couple to an object such as a connecting link 19, a flange 5 that projects radially from the connecting hub 20, and at least one aperture 4 extending through the flange 5. The flange 5 is configured to reinforce the surrounding material; e.g., flange 5 is a reinforcement flange. For example, the flange 5 is configured to enlarge the overall width of the anchored connecting body 3 without increasing the width of the connecting hub 20 itself, which allows additional strength to be added to the entire anchored connecting body 3 without significantly increasing its volume. Further, the flange 5 introduces a new geometry into the connecting body 3 that allows for additional geometric interaction with the first material of a main body, such as the stretchy main body 2, since the flange 5 helps minimize or prevent the tilting of the axis of the connecting hub 20 due to the flange 5 projecting radially from the connecting hub. This configuration of the anchored connecting body 3 is favorable over a standard grommet due to the increased resistance of the anchored connecting body 3 being torqued inside the first material of the main stretchy body 2, which thereby helps prevent the parts from beginning to separate from each other.

Further, the aperture 4 in the flange 5 helps to further reduce the likelihood of separation between the stretchy main body 2 and the anchored connecting body 3 by providing a space completely through the anchored connecting body 3 for the first material to substantially occupy and be continuous therethrough, such that the anchored connecting body 3 and the stretchy main body 2 are permanently interlocked. Stated another way, the first material can flow through the aperture 4, during manufacturing, and join back together with the same first material on the opposite side of the flange 5, thus creating a permanent interlock between the main stretchy body 2 and the anchored connecting body 3. In various embodiments, anchored connecting body 3 can comprise a plurality of apertures 4, such as 2, 3, 4, 5, 6, 7, 8, or more, in the interior section of the flange 5 between its outer edge and the connecting hub 20, thereby increasing the number of connections the first material makes to itself through any number of separate apertures 4 in the flange 5, thereby increasing the reinforcement of the first material and its ability to maintain a secure hold on to the anchored connecting body 3.

The anchored connecting body 3 can be used for connection to the main stretchy body 2 via the connecting hub 20 when the forces of the connection cause the main stretchy body 2 to be stretched greatly towards the connected object or away from the main stretchy body 2. With the said mechanical interlock between the main stretchy body 2 and the anchored connecting body 3, it is difficult in said configuration to separate the two components since a complete failure of either the main stretchy body 2 or the anchored connecting body 3 is required for separation. This arrangement where the main stretchy body 2 and the anchored connecting body 3 are permanently interlocked is also favorable over a simple grommet because a simple grommet can be easily separated from a stretchy material since it is easy for a stretchy material to change its shape and easily and completely disconnect from the grommet.

Another factor that facilitates strengthening the connection of the anchored connecting body 3 to the main stretchy body 2 is the permanent bonding of these two components to one another. By comparison, a simple grommet is not bonded to the material that it is attempting to reinforce. Without this permanent bond, when the grommet separates from the material it is attempting to reinforce, the load on that material is again localized, and the grommet becomes much less effective at preventing a failure.

In various embodiments, a permanent bond can be accomplished by using an adhesive that is permanent and non-removable from either material, or more favorably by fusing the first materials of the stretchy body 2 and the second material of the anchored connecting body 3 to each other. Such fusion typically occurs during the manufacturing process of creating the completed footwear securing member 1. A fusion of the two materials can be beneficial because a third adhesive component is not required, and also because the fusion of the materials creates a bond that effectively creates a unitary footwear securing member 1 whereby one part is made up of two different, fused materials that perform different but complementary functions. In such embodiments, where the materials are fused to one another, maximizing the surface area where the fusion occurs can be beneficial, as a greater surface area of fusion results in a stronger overall bond between the two parts and encourages more dispersion of forces applied to said parts. Therefore, as the anchored connecting body 3 can be configured to be relatively small in comparison to the main stretchy body 2, configure the anchored connecting body 3 to have adequate surface area for fusion to the first material of the main stretchy body 2.

Moreover, in order to disperse forces of many types and from multiple directions imparted by the connection via the connecting hub 20, such as torquing, twisting, and pulling, the anchored connecting body 3 can also comprise outer surfaces and/or features that are oriented in a variety of directions that are available for fusion to the first material. Each feature on the anchored connecting body 3 facilitates this diversity in the configuration of its surfaces and features. In addition, the placement of the anchored connecting body 3 inside the main stretchy body 2 further facilitates excellent surface area available for fusion of these components to each other in order to achieve the maximum possible force dispersion. For example, the outer surface of the connecting hub 20 as well as the outer surface of the flange 5 provide surfaces perpendicular to the outer wall of the connection hub 20 for fusion to occur. The top and bottom surfaces of the flange 5 further provide surfaces parallel to the outer surface of the connection hub 20 for fusion to occur. Since the entire periphery of the anchored connecting body 3 is surrounded by the first material of the main stretchy body 2, the perpendicular and parallel surfaces both handle forces in all directions outward from the connecting hub 20, and the diversification of their load directions are beneficial in resisting failure during many different and diverse types of loading. Further, since in a preferred embodiment the connection hub 20 and flange 5 can be cylindrical in shape, the lack of edges on said perpendicular and said parallel surfaces further eliminate any points where forces or stresses can focus, further dispersing said forces and stresses across broader surface areas. In addition, the apertures 4 provide even further surface area for bonding, and act as additional features to add to the overall diversified geometry that is beneficial to ensure that any type of load does not result in a failure of the part due to any forces being localized. This diversification of fusion features for force dispersement prevents the anchored connecting body 3 from ever separating from the main stretchy body 2, and since these parts effectively act as one component the forces from the connections are truly dispersed over a much broader section of the footwear securing member 1, thus contributing to its ability to handle multiple types of load at its connection points.

Suitable materials for the main elastomeric body 2 can be rubber, thermoplastic elastomer, thermoplastic rubber, thermoplastic polyurethane, or any durable stretchy material. Suitable materials for the anchored connecting body 3 can be plastic, thermoplastic polyurethane, rubber, or any durable material with higher tear resistance than the material used for the main stretchy body 2. In an embodiment, the anchored connecting body 3 can be injection molded from thermoplastic polyurethane, and the main stretchy body 2 can be injection molded out of thermoplastic elastomer, where the main stretchy body 2 can be overmolded over the anchored connecting body 3 during manufacturing of the footwear securing member 1. Suitable materials for the connecting link 19 can be metal, durable plastic, metal cable, polymer-based cable, or any durable material with a high tensile strength.

Another beneficial aspect of the anchored connecting body 3 is that a thinner profile for the footwear securing member is achievable when such arrangements of components are utilized. Traditionally, footwear securing members have had to either be relatively thick or use harder stretchy materials in order to resist failure due to forces on their connection points. This can be unfavorable, since a thicker elastomer can be bulky and/or on top of footwear, and harder stretchy materials can be heavy and are limited in the amount of elongation that they provide. Since the present disclosure includes mechanisms for dispersing forces, it is possible to gain the strength of a thicker part or harder stretchy material with a thinner and stretchy part that has been reinforced with said mechanisms where connections are required. In various embodiments, footwear securing member 1 can define a low profile. For example, the thickness of the footwear securing member 1 at the main stretchy body 2 can be within a range of 0.7 mm to 5 mm. On a section of the footwear securing member 1 at the anchored connecting body 3, the thickness can be within a range of 1.5 mm to 8 mm. Accordingly, the thickness of the anchored connecting body 3 at the connection hub 20 can also be within a range of 1.5 to 8 mm. The thickness of the anchored connecting body 3 at the flange 5 can be within a range of 0.5 mm and 4 mm.

With reference to FIGS. 15*a* to 15*d* and 16*a* to 16*b*, in accordance with another aspect of the present disclosure, a toe bail reinforcement 50 can comprise a connecting body 3*a* can be coupled to another connecting body 3*b* by way of a bridge piece 25 that extends therebetween. The bridge piece 25 can be unitary with (e.g., integrally molded) or coupled to the connecting bodies 3*a*, 3*b*. The bridge piece 25 can be partially or completely embedded in the elastomeric body 2 of the footwear securing member 1.

One or both of the connecting bodies 3*a*, 3*b* can be like that described above in connection with FIGS. 10 to 14. Specifically, in the embodiment shown, the toe bail reinforcement 50 comprises a first connecting body 3*a* and a second connecting body 3*b* and a bridge piece 25 extending between the two connecting bodies 3*a*, 3*b*. Each connecting body 3*a*, 3*b* comprises a connecting hub 20*a*, 20*b* and a flange 5*a*, 5*b* that projects radially from the respective connecting hub 20*a*, 20*b*. The connecting hub 20*a*, 20*b* can comprise an attachment feature, such as the hole 6*a*, 6*b*. The bridge piece 25 extends between the two hubs 20*a*, 20*b* and merges with flanges 5*a*, 5*b*. The flanges 5*a*, 5*b* each define at least one aperture 4*a*, 4*b* through the flange 5. While note shown, the bridge piece 25 can also comprise at least one aperture that can comprise a hole through the bridge piece.

The bridge piece 25 can be configured to withstand stretching in a lengthwise direction (i.e., along axis D-D) under the forces encountered during the wearing of such footwear traction devices. Stated another way, the bridge piece 25 is configured to maintain a constant or substantially constant distance between the two connecting bodies 3*a*, 3*b*. For example, the bridge piece 25 can be an elongated bar, strip, slat of material composed of a rigid or semi-rigid material. A bridge piece 25 made of a semi-rigid material can bend to the curvature of the shoe. A rigid bridge piece 25 may need to have a curved shape to conform better to the curvature of the shoe.

In various embodiments, particularly for those that are configured to fit over a running shoe or the like, the toe bail reinforcement 50 can be between about 2 cm to about 10 cm in length (D-D), such as 3 cm, 4 cm, 5 cm, 6 cm, 7 cm, 8 cm, or 9 cm. The length of the bridge piece can be about 1 to about 10 times the diameter (measured on a line perpendicular to D-D that passes through the hole 6*a*, 6*b*, of the flange 5*a*, 5*b*, such as 2 times, 3 times, 4 times, 5 times, 6 times, 7 times, 8 times, 9 times.

Figure 17A:
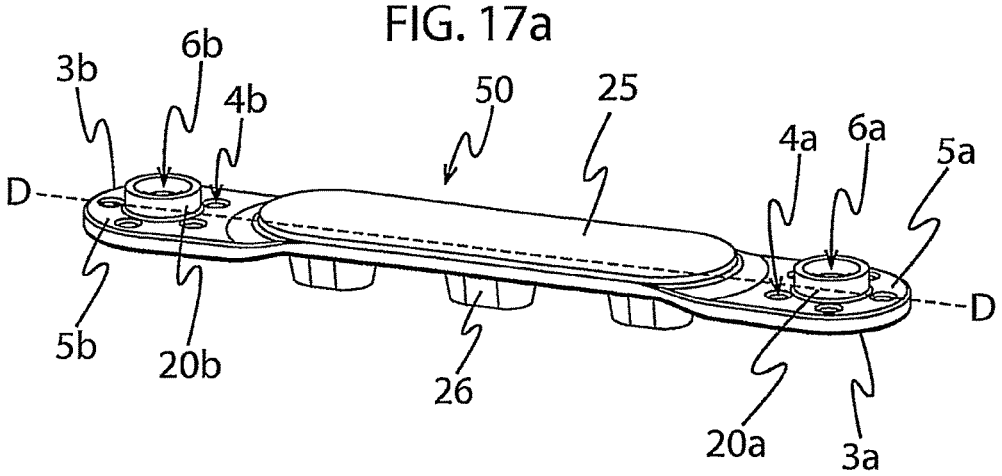
FIG. 17*a* illustrates a top, perspective view of a bridged connecting body embodiment with raised surface features.
Figure 17B:
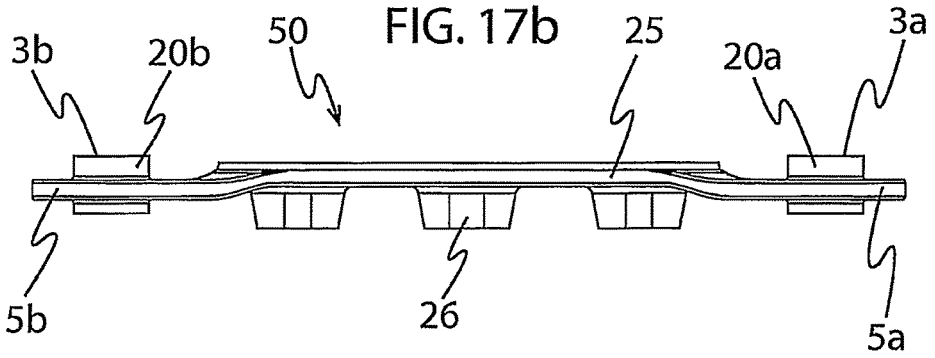
FIG. 17*b* illustrates a side view of the embodiment shown in FIG. 17*b*.
Figure 18B:
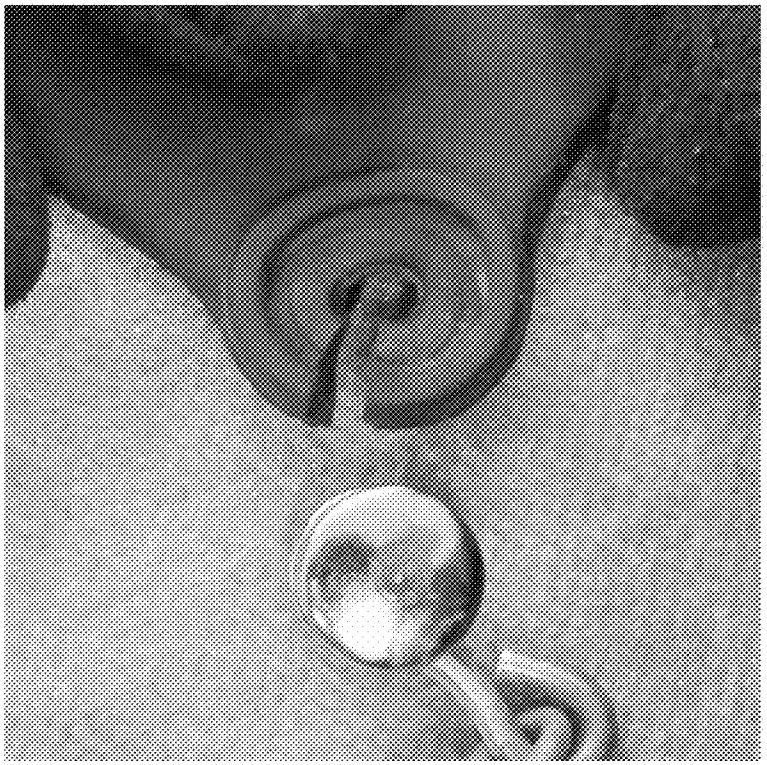
Figure 18A:
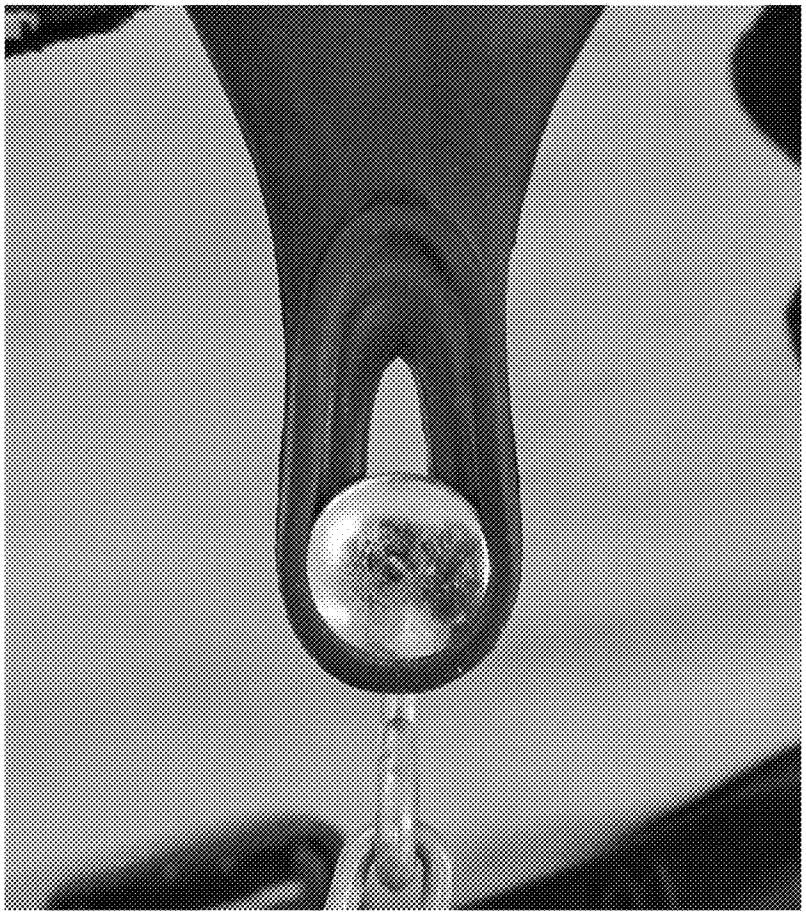
Figure 19B:
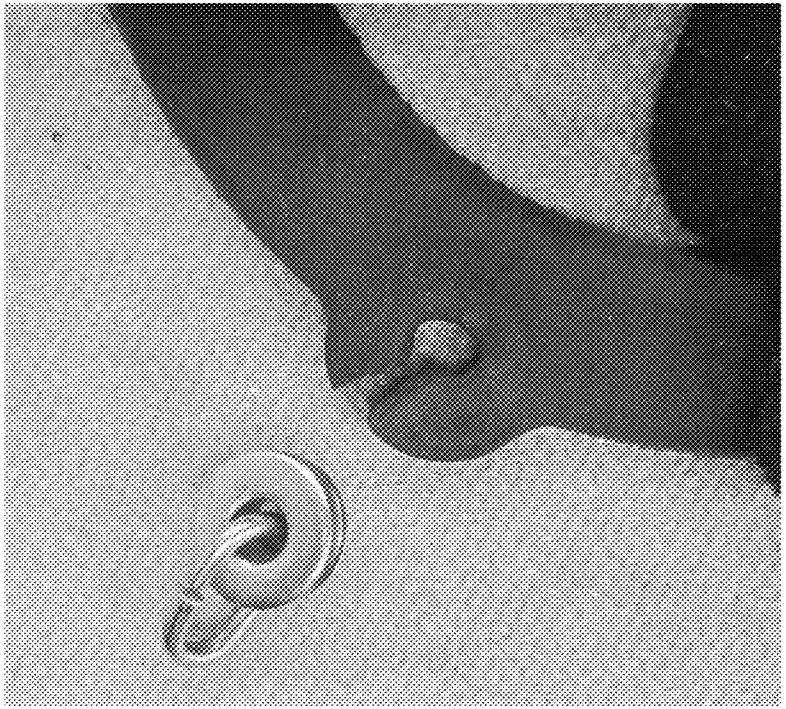
Figure 19A:
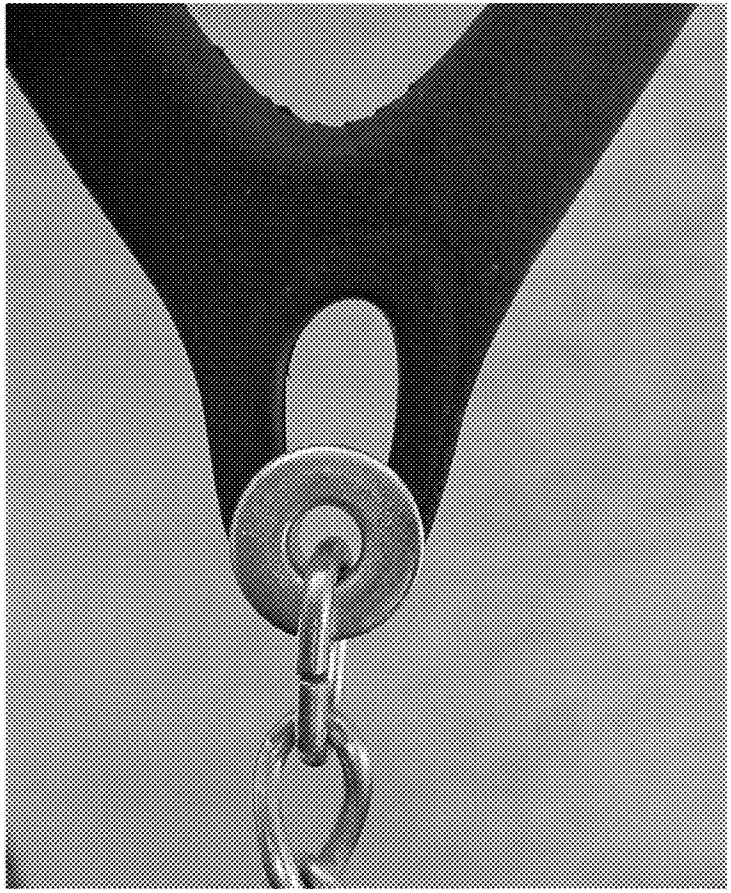
Figure 20B:
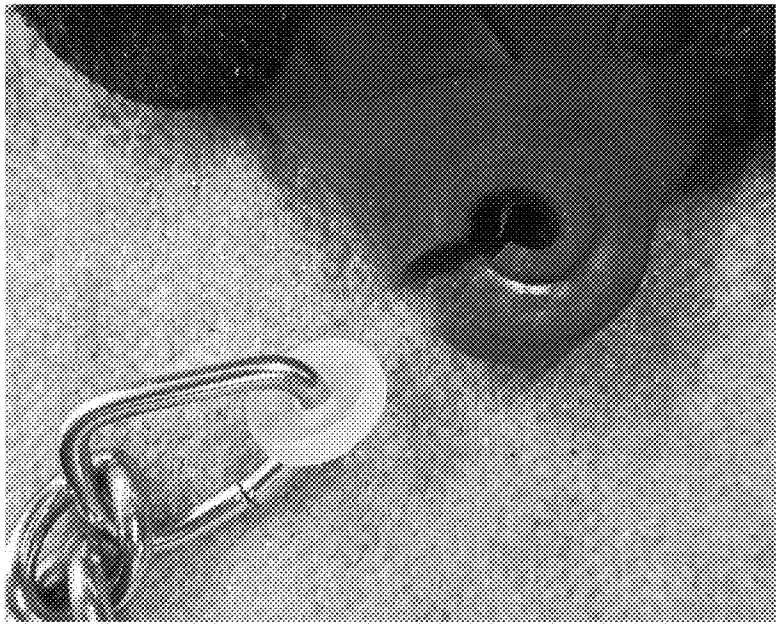
Figure 20A:
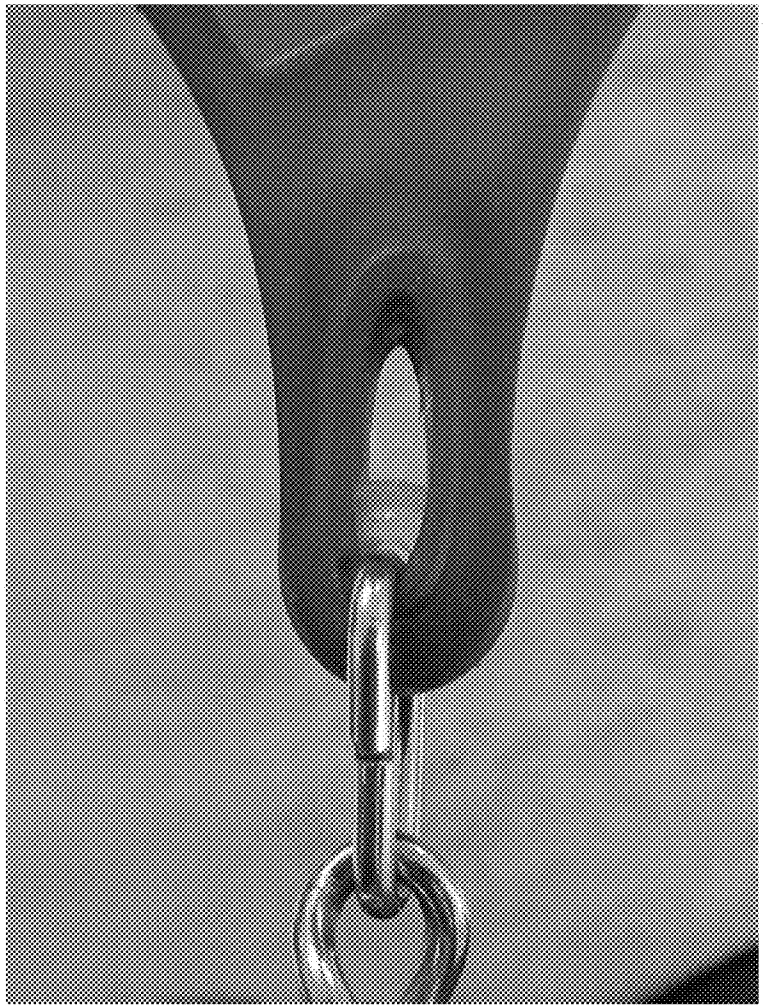
Figure 21B:
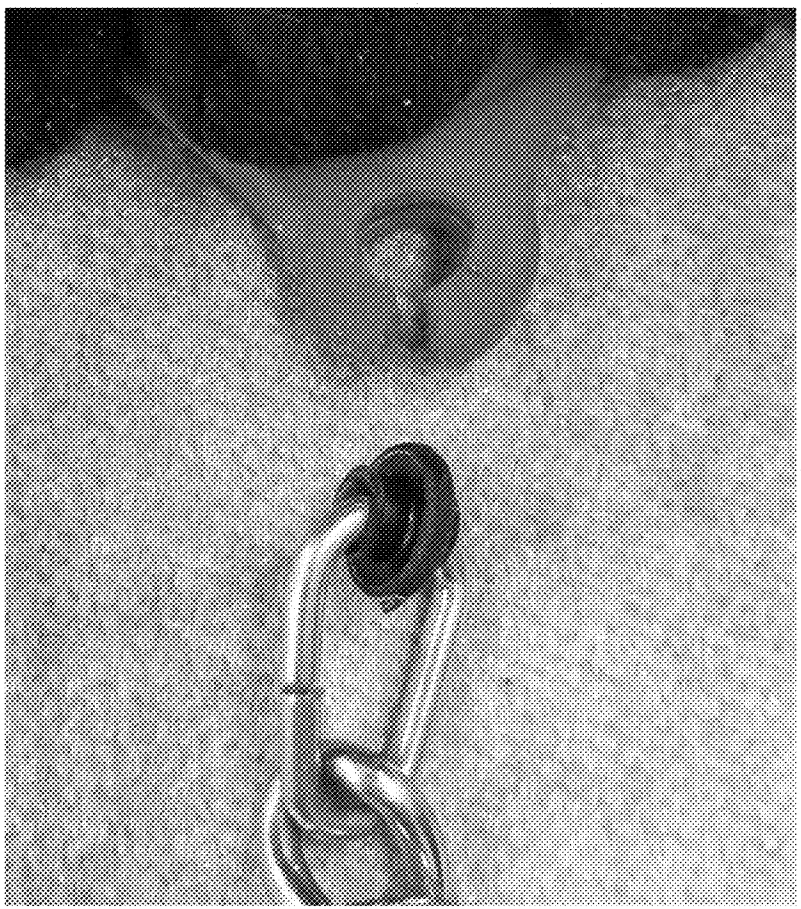
Figure 21A:
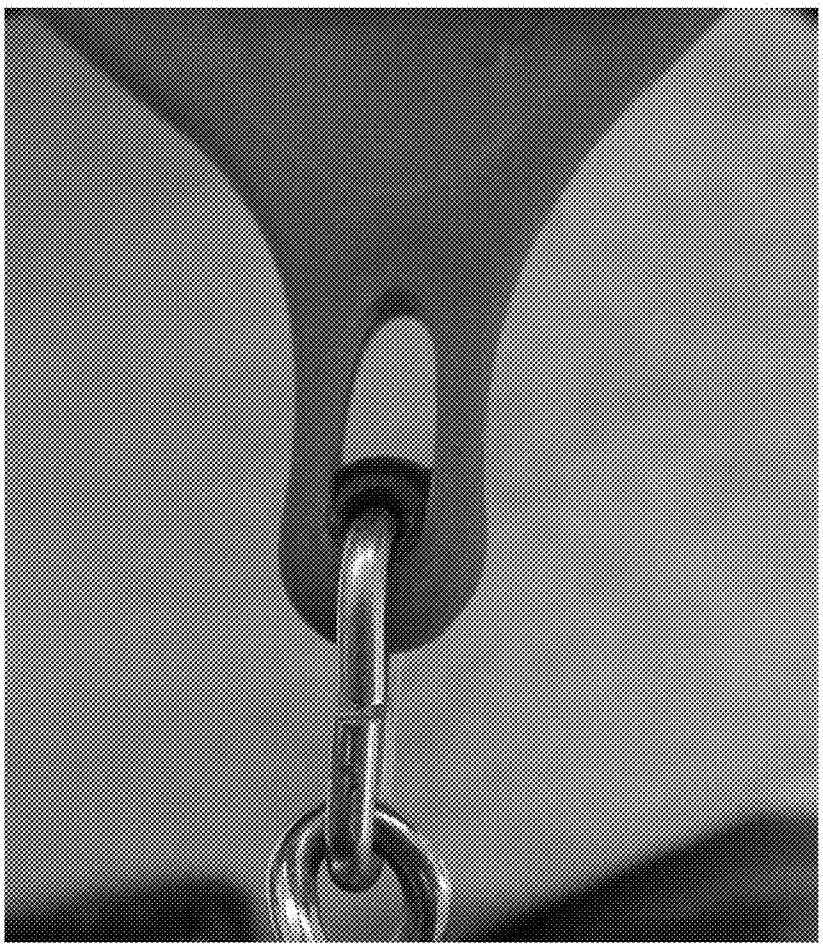
Figure 22B:
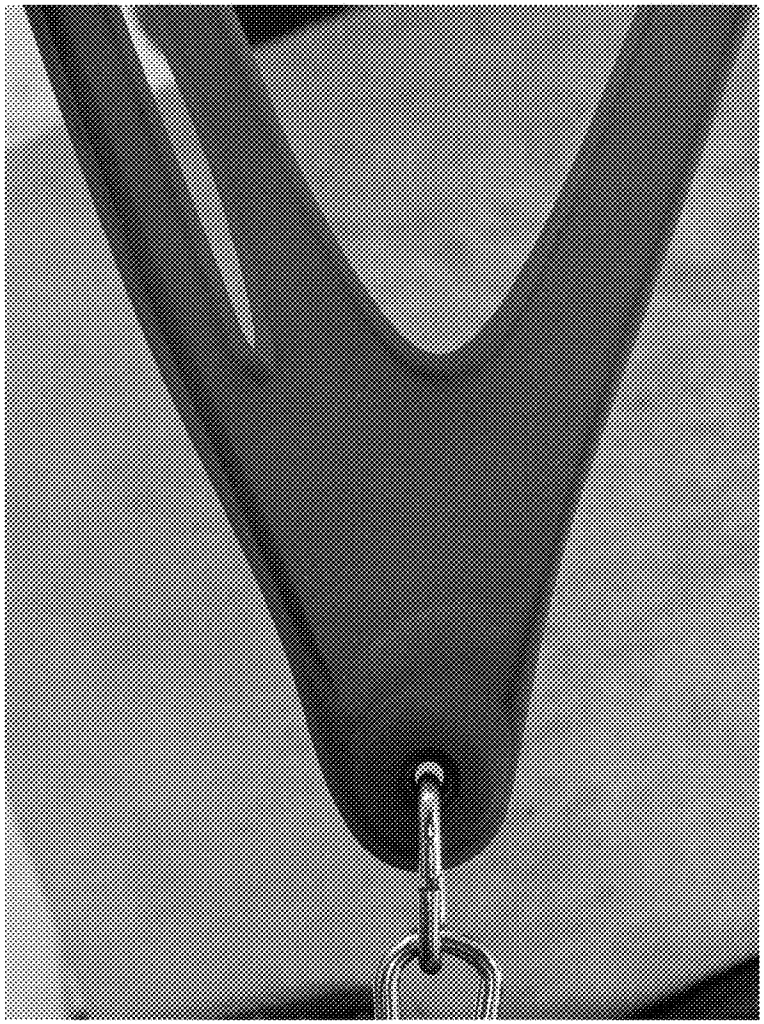
Figure 22A:
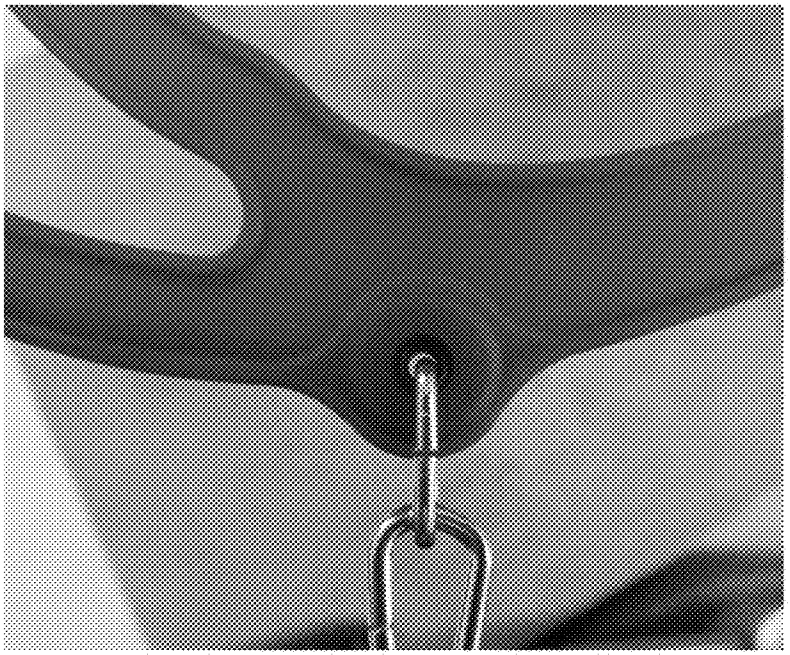
Figure 22D:
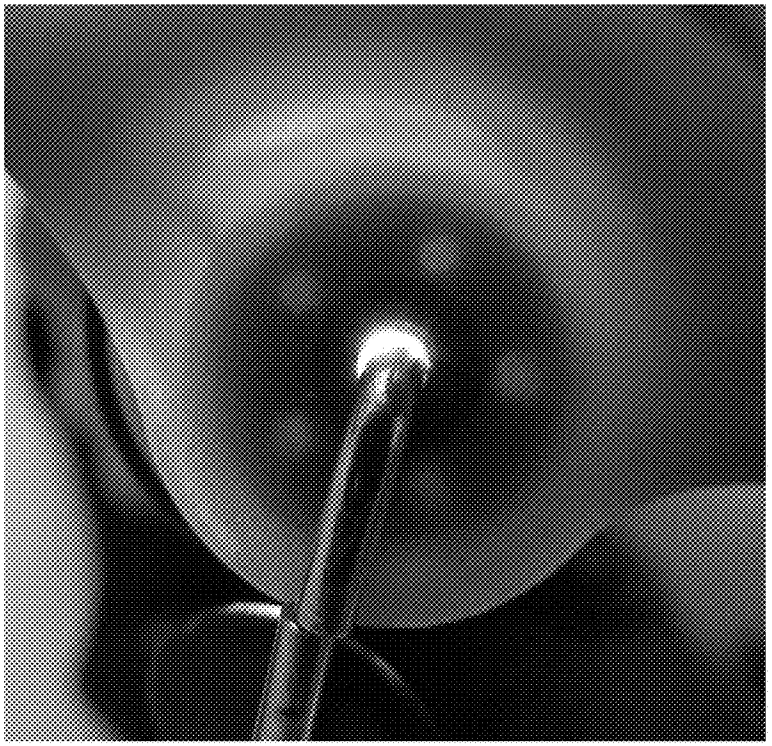
Figure 22C:
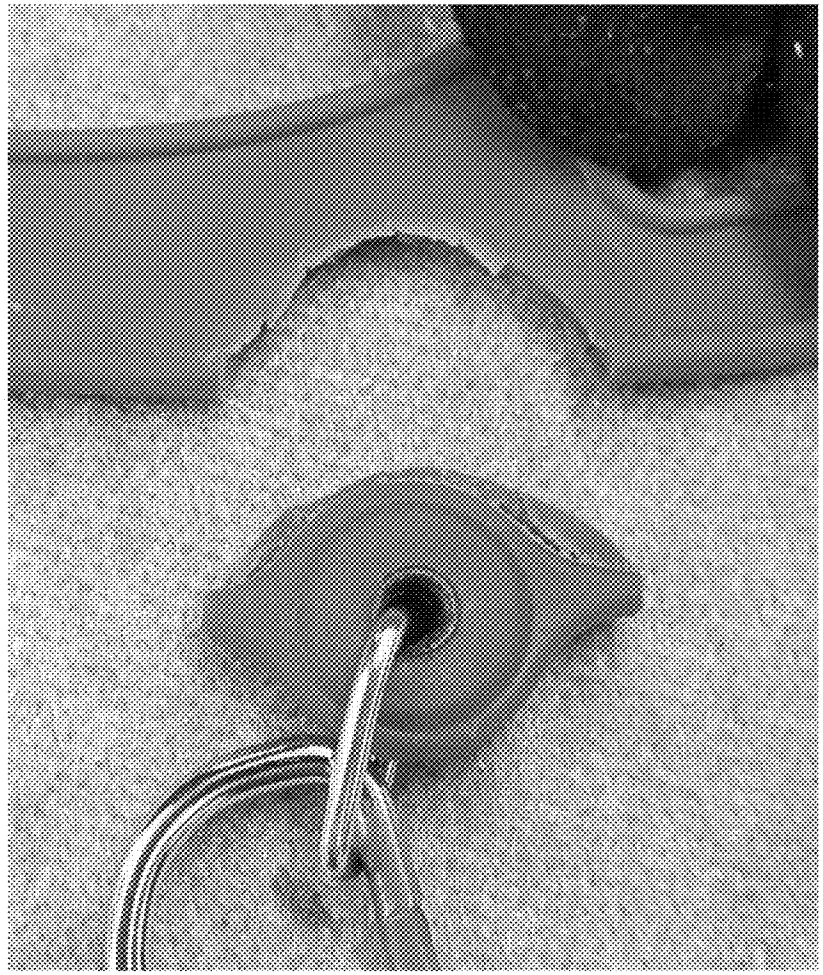
Figure 22F:
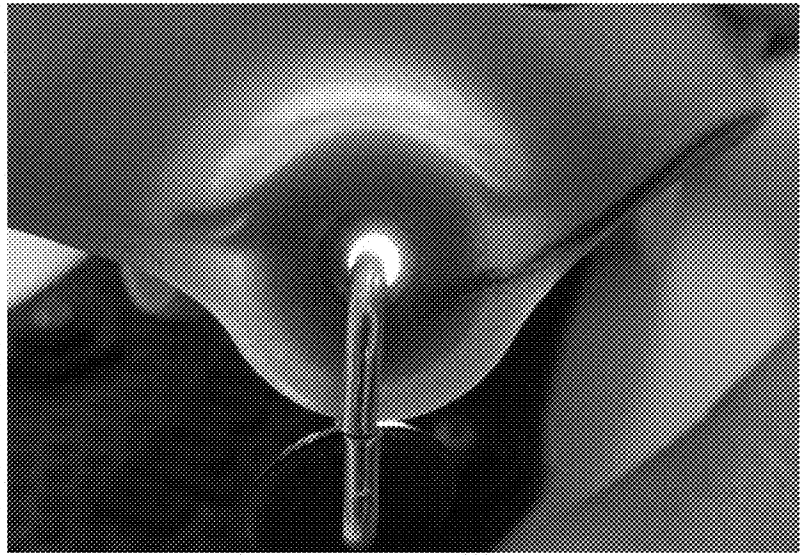
Figure 22E:
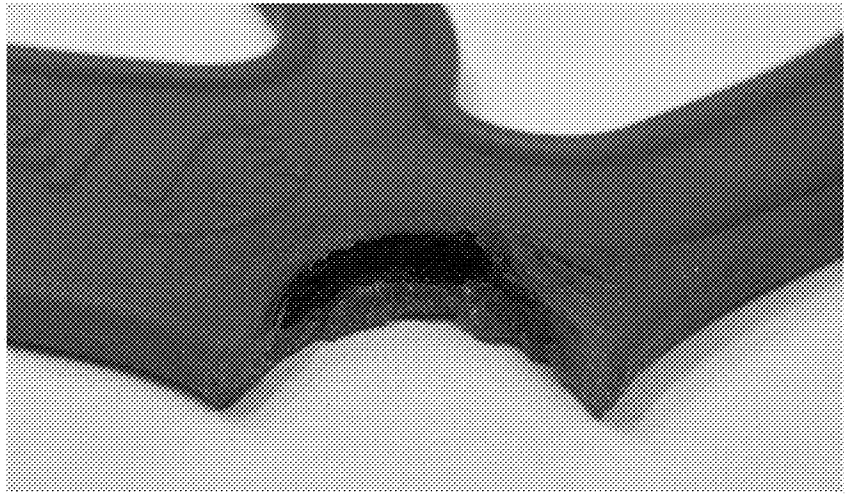

In various embodiments, the bridge piece 25 can also comprise elements that aid in the manufacturing process. For example, the bridge piece 25 can comprise a surface projection that facilitates the proper positioning of the component in a footwear securing member mold. In some embodiments, the raised surface features when integrated with the harness, are exposed at the surface (i.e., not embedded in the stretch material). An example of such raised features 26 are shown in FIGS. 17*a* and 17*b*.

In various embodiments, the material of the bridge piece 25 is the same as the connecting bodies 3*a*, 3*b*. Suitable material can be plastic, thermoplastic polyurethane, rubber, or any durable material with higher tear resistance than the material used for the main stretchy body 2. In an embodiment, the bridge piece 25 can be injection molded from thermoplastic polyurethane.

The above specification and examples provide a complete description of the structure and use of an exemplary embodiment. Although certain embodiments have been described above with a certain degree of particularity, or with reference to one or more individual embodiments, those skilled in the art could make numerous alterations to the disclosed embodiments without departing from the scope of this invention. As such, the illustrative embodiments of the present connecting devices and systems and traction devices and systems are not intended to be limited to the particular forms disclosed. Rather, they include all modifications and alternatives falling within the scope of the claims, and embodiments other than the one shown may include some or all of the features of the depicted embodiment. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not to be interpreted as including means-plus- or step-plus-function limitations, unless such a limitation is explicitly recited in a given claim using the phrase(s) "means for" or "step for," respectively.

The invention claimed is:

1. A traction device comprising at least one traction member having a top surface, a bottom surface, and a periphery, the traction member comprising at least one layered section having at least a bottom layer comprised of a first material defining the bottom surface for the at least one layered section and an adjacent layer disposed above the bottom layer comprised of a second material;

at least one first cleat comprising a first portion and a second portion, wherein said first portion of the cleat comprises a radially projecting flange that is embedded within the bottom layer and at least a portion of said second portion extends outward from the bottom surface, wherein the first material is softer than the second material and wherein the first cleat comprises a first end located in the first portion, wherein the first end is spaced apart from the adjacent layer an amount between about 0.5 mm to about 3.0 mm; and a footwear securing member, wherein the footwear securing member comprises an elastomeric band configured to fit around the footwear along a toe portion, a left side portion, a heel portion, and a right side portion;

a connecting hub having a proximal end, a distal end, and an intermediate section there between; and a flange radially projecting from the connecting hub within the intermediate region, the flange having an outer edge and an interior region, the flange comprising at least two apertures within the interior region, where the flange is embedded in the elastomeric band and where the connecting hub is configured to couple to the at least one traction member.

2. The traction device of claim 1, wherein the first portion of the first cleat is a stud holder comprising a first end and a second end, the stud holder at the first end having a radially projecting flange, and the stud holder at the second end having a hole extending at least partially therethrough and configured to receive the second portion, the second portion being a traction stud.

3. The traction device of claim 1, further comprising a polymeric traction element that protrudes from the bottom surface, wherein the polymeric traction element is a surface projection surrounding the first cleat.

4. The traction device of claim 3, wherein the polymeric traction element is a stepped or sloping surface projecting feature.

5. The traction device of claim 3, wherein the polymeric traction element spans a width that is at least 3 times the width of the second portion of the first cleat.

6. The traction device of claim 1, wherein the traction device comprises at least four connecting arms, each arm extending from the periphery of the traction member and terminating at a distal end such that a first set of two arms are substantially opposite each other and a second set of two arms are substantially opposite each other and each connecting comprising an attachment feature near the distal end configured to couple the connecting arms to a footwear securing member.

7. The traction device of claim 1 comprising two of the traction members, wherein, a first traction member is configured to extend along the underside of an item of footwear in the forefoot region;

a second traction member configured to extend along the underside of an item of footwear in the rearfoot region; and four connecting arms extending from the periphery of each traction member such that the four arms and the traction member form an X-like outline, each connecting arm terminating at a distal end and each comprising an attachment feature near the distal end.

8. The traction device of claim 7, wherein each of two connecting arms of a first traction member are coupled to an adjacent connecting arm of the second traction member and configured such that an angle formed by each coupled set of connecting arms increases upon the application of tension to the traction device.

9. The traction device of claim 1, wherein the footwear securing member further comprises a toe bail reinforcement comprising a first connecting hub and a second connecting hub spaced apart from each other, each connecting hub having a proximal end, a distal end and an intermediate section therebetween;

a flange radially projecting from each connecting hub within the respective intermediate region; and a bridge piece extending between and coupled to the flange where the flange of the toe bail reinforcement and at least a portion of the bridge piece are embedded in the elastomeric band in the toe portion.

10. The traction device of claim 9, wherein at least one of the flanges defines at least two apertures within the interior region.

11. A traction device comprising at least one traction member having a top surface, a bottom surface, and a periphery, the traction member comprising at least one layered section having at least a bottom layer comprised of a first material and an adjacent layer disposed above the bottom layer comprised of a second material different from the first material and at least one first cleat comprising a first end and a second end opposite the first end, wherein said first end of the cleat is embedded within the bottom layer and said second end extends outward from the bottom surface, and at least one second cleat that protrudes from the top surface where one of the at least one second cleat is disposed above one of the at least one first cleat; and a footwear securing member configured to couple to the at least one traction member, wherein the traction device is configured to be worn over footwear such that the at least one traction member is disposed on the underside of the footwear, wherein the footwear securing member comprises an elastomeric band configured to fit around the footwear along a toe portion, a left side portion, a heel portion, and a right side portion;

a connecting hub having a proximal end, a distal end, and an intermediate section there between; and a flange radially projecting from the connecting hub within the intermediate region, the flange having an outer edge and an interior region, the flange comprising at least two apertures within the interior region, where the flange is embedded in the elastomeric band and where the connecting hub is configured to couple to the at least one traction member.

12. The traction device of claim 11, wherein the first material is softer than the second material and wherein the first portion of the first cleat is a stud holder comprising a first end and a second end, the stud holder at the first end having a radially projecting flange, and the stud holder at the second end having a hole extending at least partially therethrough and configured to receive the second portion, the second portion being a traction stud.

13. The traction device of claim 1, further comprising a footwear securing member configured to couple to the at least one traction member, wherein the traction device is configured to be worn over footwear such that the at least one traction member is disposed on the underside of the footwear.

14. A traction device comprising at least one traction member having a top surface, a bottom surface, and a periphery and a footwear securing member configured to couple to the at least one traction member, wherein the traction device is configured to be worn over footwear such that the at least one traction member is disposed on the underside of the footwear, wherein the footwear securing member comprises an elastomeric band configured to fit around the footwear along a toe portion, a left side portion, a heel portion, and a right side portion;

a connecting hub having a proximal end, a distal end, and an intermediate section there between; and a flange radially projecting from the connecting hub within the intermediate region, the flange having an outer edge and an interior region, the flange comprising at least two apertures within the interior region, where the flange is embedded in the elastomeric band and where the connecting hub is configured to couple to the at least one traction member.

15. The traction device of claim 13, wherein the hardness of the first material is in the range of about Shore 55A to about Shore 95A.

16. The traction device of claim 15, wherein the hardness of the second material is at least Shore 40D.

17. The traction device of claim 16, further comprising at least one second cleat that protrudes from the top surface and wherein the second portion of the first cleat comprises metal and the second cleat is disposed above the first cleat.

18. The traction device of claim 17, wherein the second cleat is integral with the adjacent layer.

* * * * *